US008711064B2

(12) United States Patent
Hirakawa et al.

(10) Patent No.: US 8,711,064 B2
(45) Date of Patent: Apr. 29, 2014

(54) DIGITAL SIGNAL PROCESSING APPARATUS, LIQUID CRYSTAL DISPLAY APPARATUS, DIGITAL SIGNAL PROCESSING METHOD AND COMPUTER PROGRAM

(75) Inventors: Takashi Hirakawa, Tokyo (JP); Masakazu Aoki, Tokyo (JP); Naoki Ohashi, Kanangawa (JP)

(73) Assignee: Sony Corporation, Tokyo (JP)

( * ) Notice: Subject to any disclaimer, the term of this patent is extended or adjusted under 35 U.S.C. 154(b) by 1357 days.

(21) Appl. No.: 12/232,346

(22) Filed: Sep. 16, 2008

(65) Prior Publication Data

US 2009/0073090 A1 Mar. 19, 2009

(30) Foreign Application Priority Data

Sep. 18, 2007 (JP) ..... 2007-240348

(51) Int. Cl.
*G09G 3/18* (2006.01)
*G09G 3/36* (2006.01)

(52) U.S. Cl.
USPC ..... 345/58; 345/87

(58) Field of Classification Search
USPC ..... 345/87–104
See application file for complete search history.

(56) References Cited

U.S. PATENT DOCUMENTS

2007/0146281 A1* 6/2007 Hosihara et al. ..... 345/96
2007/0222724 A1* 9/2007 Ueno et al. ..... 345/87

FOREIGN PATENT DOCUMENTS

| | | | |
|---|---|---|---|
| JP | 2002-116735 | A | 4/2002 |
| JP | 2004-301964 | A | 10/2004 |
| JP | 2005-070339 | A | 3/2005 |
| JP | 2005-202159 | A | 7/2005 |
| JP | 2005-352444 | | 12/2005 |
| JP | 2006-053441 | A | 2/2006 |
| JP | 2006-091800 | A | 4/2006 |
| JP | 2006-162872 | A | 6/2006 |
| JP | 2006-163074 | A | 6/2006 |
| JP | 2006-243267 | | 9/2006 |
| JP | 2007-148054 | A | 6/2007 |

OTHER PUBLICATIONS

Japanese Office Action issued on Oct. 27, 2009 for corresponding Japanese Application No. 2007-240348.

* cited by examiner

*Primary Examiner* — Jonathan Horner
(74) *Attorney, Agent, or Firm* — Rader, Fishman & Grauer PLLC

(57) ABSTRACT

A digital-signal processing apparatus for processing elementary-color data to be output to a liquid-crystal display apparatus having a color panel structure, the digital-signal processing apparatus including: a line-unit weight-coefficient sum computation section; a compensation-coefficient computation section; a partial-weight-coefficient-sum computation section; a first-compensation-quantity-component computation section; a second-compensation-quantity-component computation section; a compensation-quantity computation section; a line memory used for applying a 1-line period extension process to each elementary-color data; and a horizontal-cross-talk compensation section for successively compensating each elementary-color data, which has been subjected to the 1-line period extension process in the line memory.

13 Claims, 24 Drawing Sheets

NO BLACK SIGNAL ELECTRIC POTENTIAL

WITH BLACK SIGNAL ELECTRIC POTENTIAL

NOTE: Va>Vb

FIG.11

| THRESHOLD SETTING | 000~200h | 200~400h | 400~600h | 600~800h | 800~FFFh |
|---|---|---|---|---|---|
| WEIGHT COEFFICIENT | 2 | 1 | 0 | -1 | -2 |

FIG.12C WEIGHT COEFFICIENT

FIG.12D R_th_add

FIG.12E G_th_add

FIG.12F B_th_add

FIG.13

<COMPUTATION EXAMPLE 1>

$\alpha$_R= (R_th_sum + G_th_sum + B_th_sum)/3

$\alpha$_G= (R_th_sum + G_th_sum + B_th_sum)/3

$\alpha$_B= (R_th_sum + G_th_sum + B_th_sum)/3

<COMPUTATION EXAMPLE 2>

$\alpha$_R= (R_th_sum + G_th_sum + B_th_sum) •P_r $\alpha$_G= (R_th_sum + G_th_sum + B_th_sum) •P_g $\alpha$_B= (R_th_sum + G_th_sum + B_th_sum) •P_b

FIG.14C WEIGHT COEFFICIENT

FIG.14D R_th_add

FIG.14E G_th_add

FIG.14F B_th_add

FIG.15

<TYPICAL COMPUTING EQUATIONS>

$$C_R = R_data_f * x\ (\alpha_R - \beta_R) + R_data_b * x\ \alpha_R$$

$$C_G = G_data_f * x\ (\alpha_G - \beta_G) + R_data_b * x\ \alpha_G$$

$$C_B = B_data_f * x\ (\alpha_B - \beta_B) + R_data_b * x\ \alpha_B$$

DIGITAL SIGNAL PROCESSING APPARATUS, LIQUID CRYSTAL DISPLAY APPARATUS, DIGITAL SIGNAL PROCESSING METHOD AND COMPUTER PROGRAM

CROSS REFERENCES TO RELATED APPLICATIONS

The present invention contains subject matter related to Japanese Patent Application JP 2007-240348 filed in the Japan Patent Office on Sep. 18, 2007, the entire contents of which being incorporated herein by reference.

BACKGROUND OF THE INVENTION

1. Field of the Invention

An invention explained in this patent specification relates to a technology for reducing horizontal cross talks generated in a liquid-crystal display apparatus. It is to be noted that embodiments of the present invention are a digital-signal processing apparatus, a liquid-crystal display apparatus, a digital-signal processing method adopted in the digital-signal processing apparatus and a computer program implementing the digital-signal processing method.

2. Description of the Related Art

At the present day, a liquid-crystal display apparatus is mounted in various kinds of electronic equipment. FIG. 1 is a diagram showing an equivalent circuit of a substrate module 1 composing a liquid-crystal display apparatus.

The substrate module 1 includes a pixel-array section 3 formed on a glass substrate and driving circuits which are an H shift register 5, an H switch section 7 and a V shift register 9 formed or mounted in the surroundings of the pixel-array section 3.

First of all, the configuration of the pixel-array section 3 is explained. The basic configuration of the pixel-array section 3 includes m gate lines 11(0) to 11(*m*-1), n data lines 13(0) to 13(*n*-1) and m-row×n-column matrix of pixels 15 each located at an intersection of one of m gate lines 11(0) to 11(*m*-1) and one of the n data lines 13(0) to 13(*n*-1).

It is to be noted that the pixel-array section 3 shown in the diagram of FIG. 1 is used for color displays. For this reason, in the diagram of FIG. 1, data lines for red, green and blue colors on a column i are denoted by notations 13(*i*)R, 13(*i*)G and 13(*i*)B respectively. The subscript i, which is a column number, has a value in the range 0 to (n−1). Sub-pixels for red, green and blue color are denoted by notations 15R, 15G and 15B respectively.

FIG. 2 is a diagram showing an equivalent circuit of the sub-pixel. The sub-pixel employs a thin-film transistor T1 functioning as a switch device, a storage capacitor Cs for storing a signal electric potential Vsig and a liquid-crystal element LC. The liquid-crystal element LC has a structure including a pixel electrode, a facing electrode and a liquid crystal sandwiched between the pixel electrode and the facing electrode 17.

The facing electrode (Vcom) 17 is an electrode common to all pixels 15 composing the pixel-array section 3. That is to say, the facing electrode is actually formed as a single electrode covering areas occupied by the facing electrodes of all the pixels composing the pixel-array section 3.

Next, the structure of the driving circuits is explained. The H shift register 5 is a circuit device for providing a timing to apply a signal electric potential Vsig on each data line 13. In the case of the pixel-array section 3 shown in the diagram of FIG. 1, the H shift register 5 actually generates driving signals each used for controlling operations to turn on and off one of complementary switches composing the H switch section 7. Each of the mutual-complementation switches employs an n-channel FET (Field Effect Transistor) and a p-channel FET and is connected to one of the data lines 13.

It is to be noted that, as generally known, the characteristic of a liquid crystal deteriorates if the liquid crystal is driven at the same polarity. For this reason, it is generally necessary to adopt a driving method by which the polarity of the signal electric potential Vsig is inverted each line and each field. Thus, the polarity of the signal electric potential Vsig supplied to one of the main electrodes of the complementary switch is changed each line and each field.

The V shift register 9 is a circuit device for generating signals each applied on a gate line provided for a row of sub-pixels 15 in order to generate a timing with which signal electric potentials Vsig are written onto the sub-pixels 15.

SUMMARY OF THE INVENTION

Incidentally, there is a demand for a solution to a cross-talk problem raised in the contemporary liquid-crystal display apparatus. A horizontal cross talk is a phenomenon in which a signal electric potential Vsig written into a certain pixel leaks to a pixel adjacent to the certain pixel, causing a shadow or a pattern, which are not supposed to exist, to be generated on the screen. The cross talk can be a vertical cross talk generated on the screen in the vertical direction or a horizontal cross talk generated on the screen in the horizontal direction.

In this patent specification, attention is paid to the horizontal cross talk. At the present day, the horizontal cross talk is conceivably attributed mainly to two causes. As a typical one of the causes, after an electric potential is held on a specific data line, a black-signal electric potential leaks to a data line adjacent to the specific data line by way of a complementary switch. As another typical one of the causes, after an electric potential is held on a data line, a black-signal electric potential is subjected to a phase expansion sampling so that same-polarity shakes or same-polarity noises are propagated to the common electrode (Vcom) or the gate line.

FIGS. 3 to 4B are diagrams each showing a model of propagations of electric-potential variations. To be more specific, FIG. 3 is an explanatory diagram showing parasitic capacitances each serving as a propagation path of an electric-potential variation. A signal electric potential Vsig propagates from a data line 13 to a gate line 11 and a Vcom line 17 by way of the parasitic capacitances which are each shown in the explanatory diagram of the figure as a bold dashed line.

On the other hand, FIGS. 4A and 4B are a plurality of explanatory diagrams showing that a common electric potential Vcom is shaken due to an operation to write a black electric potential into a pixel. To be more specific, FIG. 4A is an explanatory diagram showing a common electric potential Vcom with no black signal electric potential. FIG. 4B is an explanatory diagram showing a state in which the common electric potential Vcom is changed to the side of a black electric potential due to an operation to write a black electric potential into a pixel as shown by dashed lines. If the stored electric potential Vb is not restored to a storage-time electric potential Va (>Vb) before the gate pulse is turned off, a horizontal cross talk occurs.

FIGS. 5A and 5B are a plurality of diagrams each showing an image of a horizontal cross talk. Each of the diagrams of FIGS. 5A and 5B shows a typical horizontal cross talk which appears when a black window is displayed on a single-color background screen of a grey color. The image of a horizontal cross talk shown in the diagram of each of FIGS. 5A and 5B has a characteristic indicating that the horizontal cross talk easily appears on the front side of the scan direction at a high concentration and easily appears on the back side of the scan direction at a low concentration.

The following description explains a technology in related art proposed for reducing horizontal cross talks as disclosed in Japanese Patent Laid-open No. 2006-243267. The technology disclosed in this patent reference is a method of computing a sum of voltages applied to a compensation-subject line by making use of coefficients each associated with one of the applied voltages as well as a sum of voltages applied to an immediately preceding line, and computing a shake quantity of the common electric potential Vcom on the basis of the difference between the two sums. In the case of this method, a voltage obtained by compensating an applied voltage corresponding an input signal by use of a shake quantity is written onto a liquid-crystal panel in order to reduce horizontal cross talks.

However, this technology relates to a monochrome panel. Thus, even if the technology is applied to a liquid-crystal display apparatus having a color panel structure, the effect of elementary-color data of another adjacent color on an adjacent pixel is not taken into consideration. In addition, this technology is for solving only the problem of a horizontal cross talk caused by a leak of the signal electric potential Vsig.

On top of that, in accordance with this technology, the compensation quantity is determined without regard to a positional relation of compensation-subject pixels arranged in the scan direction. That is to say, the compensation quantity is determined without differentiating the front and back sides of the scan direction from each other. In other words, for equal gradation levels, the same compensation quantity is used without regard to the positional relation. In this way, in the case of this technology, there is raised a problem that the positional relation is not reflected in a way or another in a compensation process in spite of the fact that the way in which a horizontal cross talk appears differs in accordance with the scan direction positional relation.

Japanese Patent Laid-open No. 2005-352444 discloses a technology for determining the value of a horizontal cross talk by considering effects of a pixel having a color adjacent to its own color in the scan direction or a pixel adjacent to the pixel having a color adjacent to its own color in the scan direction as shown in a diagram of FIG. 6.

However, what can be compensated in accordance with this technology is limited to a range of pixels adjacent to a certain pixel or pixels adjacent to the pixels adjacent to the certain pixel. In addition, a computation equation disclosed in the document is intended to compensate the certain pixel located on the front side of the scan direction. Thus, the disclosed technology has a problem that the technology has a small effect on a pixel located on the back side of the scan direction.

In order to solve the problems described above, inventors of the present invention have proposed a digital-signal processing technology that can be applied to a liquid-crystal display apparatus having a color panel structure as a preferred technology and can be used to appropriately compensate elementary-color data for a horizontal cross talk generated on both the front and back sides of the scan direction.

That is to say, a technology having the processing operation steps described below is applied as technology providing a digital-signal processing method to be used for processing elementary-color data to be output to a liquid-crystal display apparatus having a color panel structure. The digital-signal processing method includes:

(a) a line-unit weight-coefficient sum computation step of computing a line-unit sum of weight coefficients, which are each associated with a gradation level, for each line unit of aforementioned weight coefficients and for each elementary-color data;

(b) a compensation-coefficient computation step of computing a compensation coefficient reflecting other color information of each of the line units for each elementary-color data;

(c) a partial-weight-coefficient-sum computation step of successively computing a partial weight-coefficient sum of some weight coefficients in a range starting from the head of each of the line units and ending at the position of a pixel serving as a processing subject for each elementary-color data;

(d) a first-compensation-quantity-component computation step of computing a first component of a compensation quantity for each elementary-color data as a component effective for the front end of the scan direction for the position of a pixel serving as a processing subject on the basis of a difference between the compensation coefficient and the partial-weight-coefficient sum;

(e) a second-compensation-quantity-component computation step of computing a second component of the compensation quantity for each elementary-color data as a component effective for the back end of the scan direction for the position of a pixel serving as a processing subject on the basis of the compensation coefficient;

(f) a compensation-quantity computation step of successively computing the compensation quantity to be applied to each elementary-color data at the position of a pixel serving as a processing subject on the basis of the computed first and second components;

(g) a line-period extension step of applying 1-line period extension to each elementary-color data till a compensation quantity for each elementary-color data is calculated;

(h) a horizontal-cross-talk compensation step of successively compensating each elementary-color data, which has been subjected to the 1-line period extension process in a line memory, by making use of the compensation quantity computed for each elementary-color data.

In addition, the inventors of the present invention have also proposed a digital-signal processing method for a liquid-crystal display apparatus having a color-panel structure with a double-speed display function as a method including the following operation steps:

(a) a line-unit weight-coefficient sum computation step to be carried out on the first field during a double-speed display operation as a line-unit weight-coefficient sum computation process of computing a line-unit sum of weight coefficients, which are each associated with a gradation level, for each line unit of aforementioned weight coefficients and for each elementary-color data;

(b) a compensation-coefficient computation step to be carried out on the first field during a double-speed display operation as a compensation-coefficient computation process of computing a compensation coefficient reflecting other color information of each of the line units for each elementary-color data;

(c) a line-period extension step of applying 1-line period extension to the compensation coefficient computed for the first-field during a double-speed display operation;

(d) a partial-weight-coefficient sum computation step to be carried out on the second field during a double-speed display operation as a partial-weight-coefficient sum computation process of successively computing a partial weight-coefficient sum of some compensation coefficients in a range starting from the head of each of the line units and ending at the position of a pixel serving as a processing subject for each elementary-color data;

(e) a first-compensation-quantity-component computation step to be carried out on the second field during a double-speed display operation as a first-compensation-quantity-component computation process of computing a first component of a compensation quantity for each elementary-color data as a component effective for the front end of the scan direction for the position of a pixel serving as a processing subject on the basis of a difference between the compensation coefficient and the partial weight-coefficient sum;

(f) a second-compensation-quantity-component computation step to be carried out on the second field during a double-speed display operation as a second-compensation-quantity-component computation process of computing a second component of the compensation quantity for each elementary-color data as a component effective for the back end of the scan direction for the position of a pixel serving as a processing subject on the basis of the compensation coefficient;

(g) a compensation-quantity computation step to be carried out on the second field during a double-speed display operation as a compensation-quantity computation process of successively computing the compensation quantity to be applied to each elementary-color data at the position of a pixel serving as a processing subject on the basis of the computed first and second components;

(h) a horizontal-cross-talk compensation step of successively compensating each elementary-color data, which has been supplied to the second field during a double-speed display operation, by making use of the compensation quantity associated with each elementary-color data.

In accordance with the digital-signal processing apparatus and the digital-signal processing method, which have been proposed by the inventors of the inventions, information on elementary-color data for all pixels composing 1 line can be reflected in a value associated with each elementary data as a compensation coefficient for a horizontal cross talk. To be more specific, the information is a value which is computed for each elementary-color data as an average of the line-unit sums, which are each a sum of weight coefficients each reflecting other color information of the same line. Besides, the information is a value which is computed for each elementary-color data as a product obtained by computing a total sum of the line-unit sums, which are each a sum of weight coefficients each reflecting other color information of the same line, at a predetermined ratio.

In this case, the information on elementary-color data for all pixels composing 1 line can be reflected in both a compensation quantity effective for the front side of the scanning direction and a compensation quantity effective for the back side of the scanning direction. It is thus possible to reliably improve a phenomenon in which the compensation effect is limited to the front side of the scanning direction as is the case with the method in related art. In addition, it is also possible to reliably improve a phenomenon in which a color shift is generated as a shift in a relation with the other color due to the fact that the compensation effect is completed for each color unit as is the case with the method in related art.

BRIEF DESCRIPTION OF THE DRAWINGS

These and other objects as well as features of the present invention will become clear from the following description of the preferred embodiments given with reference to the accompanying diagrams, in which:

FIG. 11 is a diagram showing a typical relation between the range of gradation levels and the weight coefficient into which a gradation level in the range is converted;

FIGS. 12A to 12F are a plurality of diagrams showing images of the line-unit weight-coefficient sums R_th_sum, G_th_sum, and B_th_sum;

FIG. 13 shows typical computing equations adopted in methods each used for computing compensation coefficients each representing the line-unit weight-coefficient sums R_th_sum, G_th_sum, and B_th_sum;

FIGS. 14A to 14F are a plurality of diagrams showing images of the partial weight-coefficient sums β_R β_G and β_B;

FIG. 15 shows typical computing equations adopted in methods for computing compensation quantities C_R, C_G and C_B;

DETAILED DESCRIPTION OF THE PREFERRED EMBODIMENTS

The following description explains preferred embodiments each implementing a digital-signal processing apparatus mounted on a liquid-crystal display apparatus adopting an active matrix driving method.

It is to be noted that a known technology and a technology disclosed to the public in the related field are applied to components which are neither described particularly in this patent specification nor shown particularly in the figures.

In addition, each of the embodiments described below is no more than a typical implementation of the present invention. That is to say, the scope of the present invention is by no means limited to the embodiments.

(A) Overall Configuration

Figure 1:
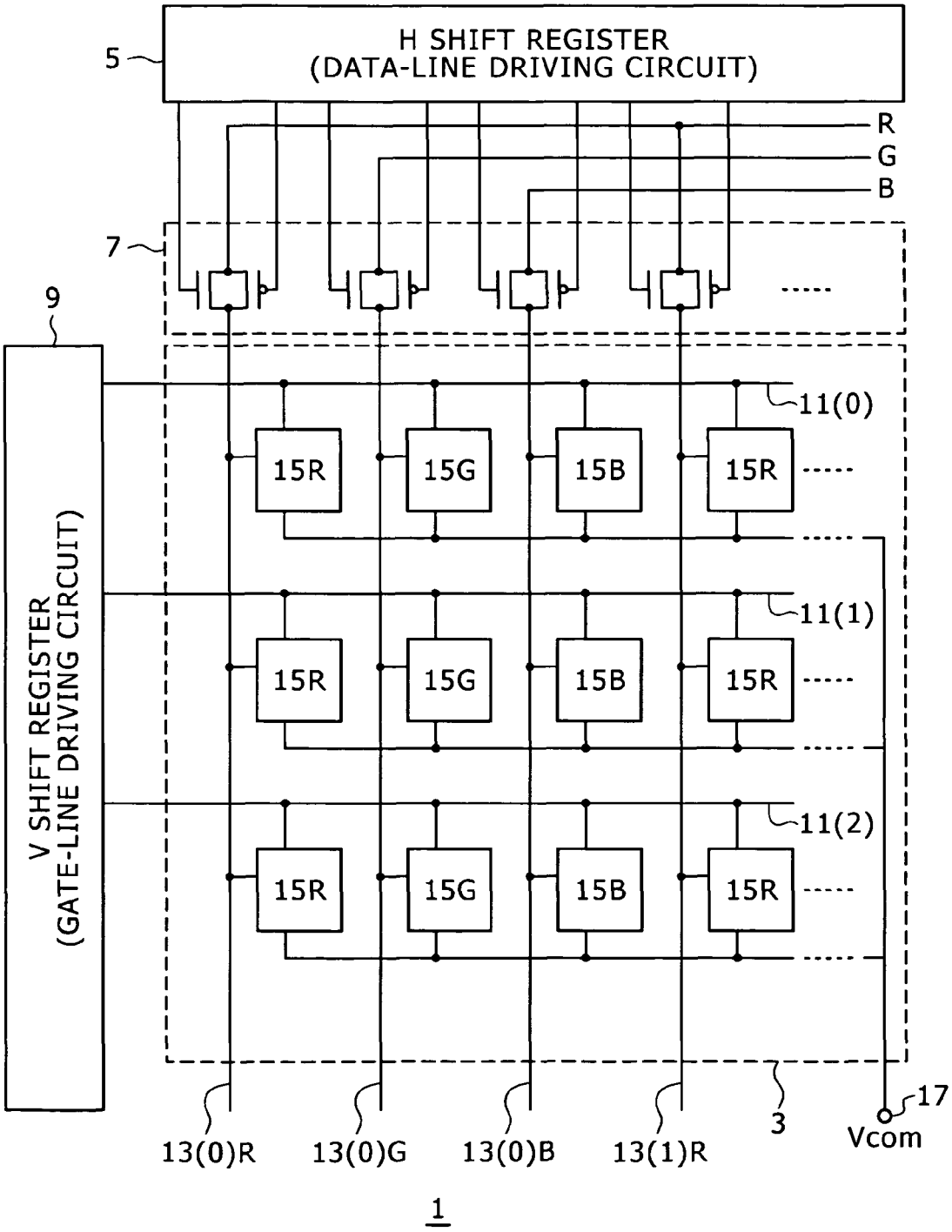
FIG. 1 is a diagram showing the circuit configuration of a substrate module.
Figure 2:
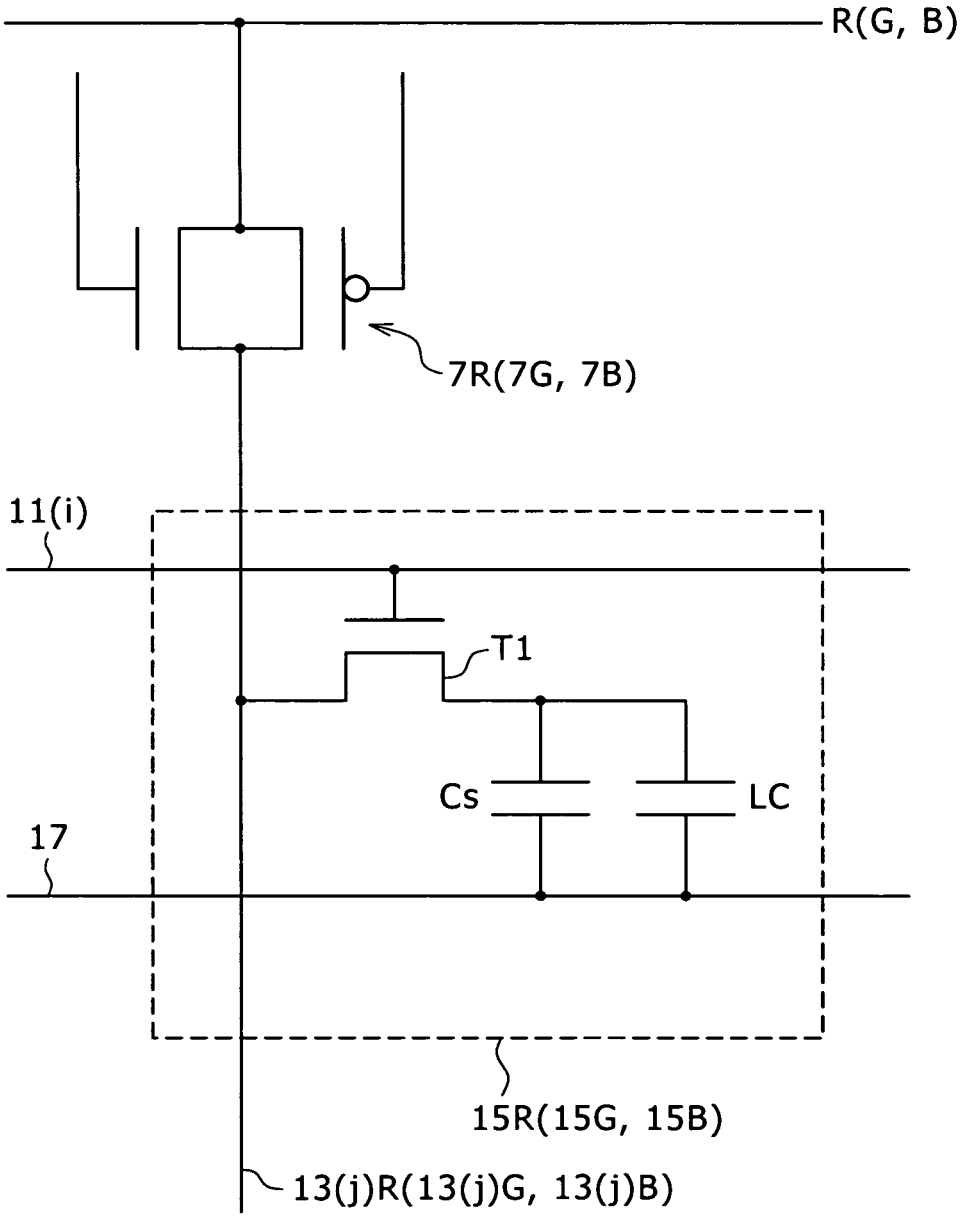
FIG. 2 is a diagram showing the circuit configuration of a sub-pixel.
Figure 3:
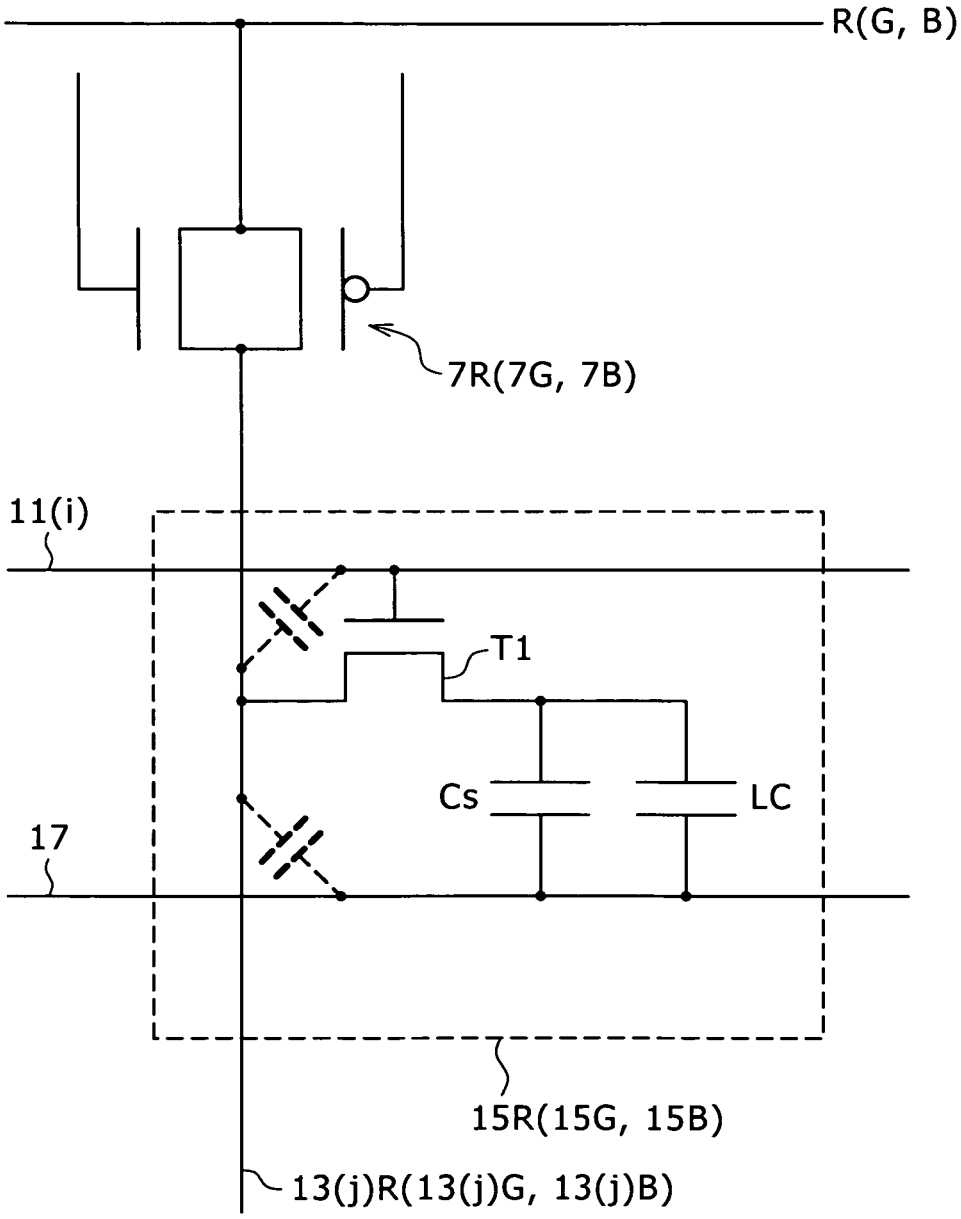
FIG. 3 is an explanatory diagram to be referred to in description of a cause generating a horizontal cross talk.
Figure 4A:
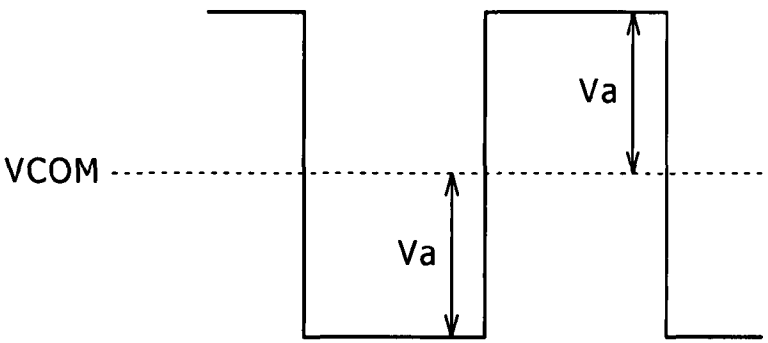
FIGS. 4A and 4B are a plurality of explanatory diagrams to be referred to in description of a cause generating a horizontal cross talk.
Figure 4B:
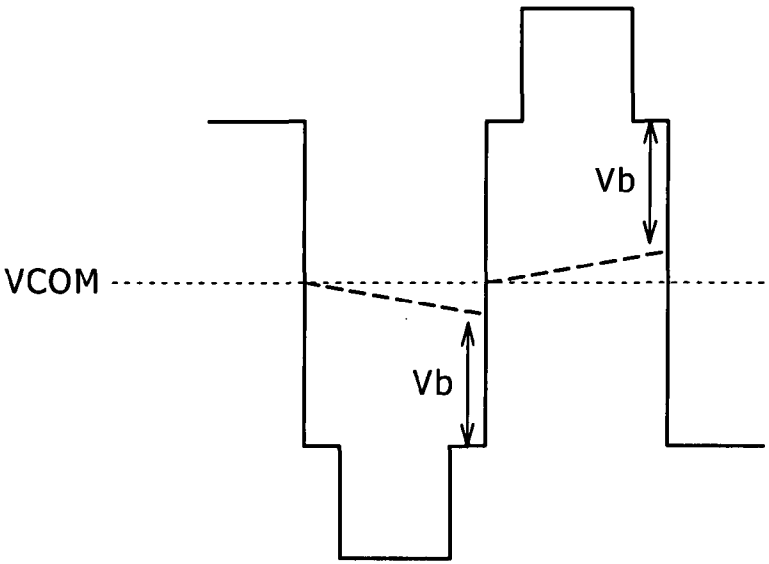
Figure 5B:
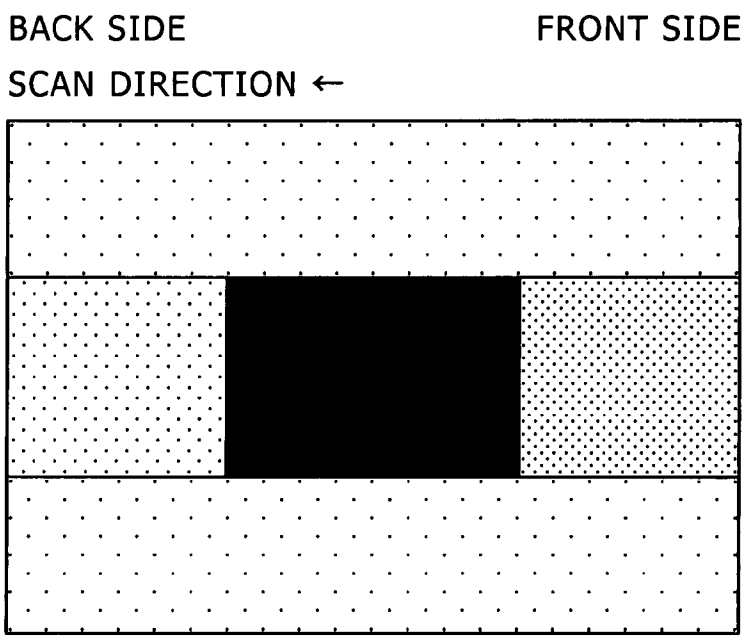
FIGS. 5A and 5B are a plurality of diagrams showing a generated image of a horizontal cross talk.
Figure 5A:
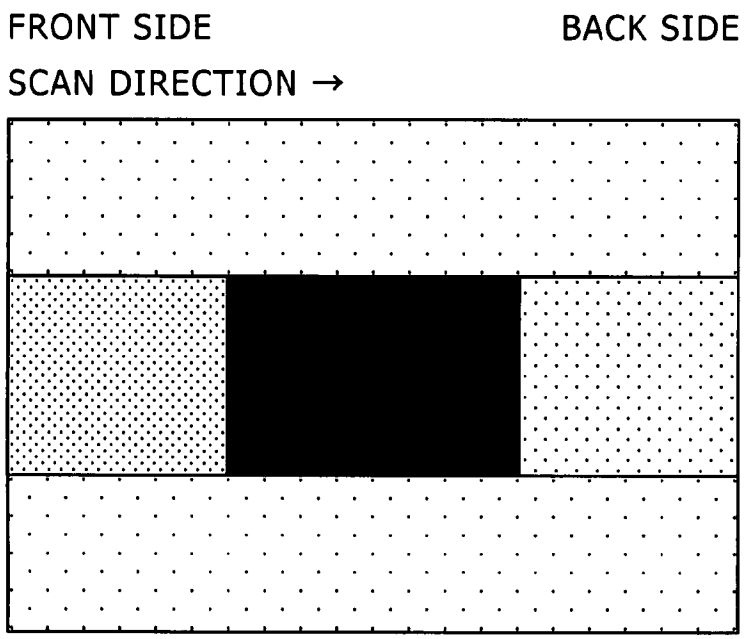
Figure 6:
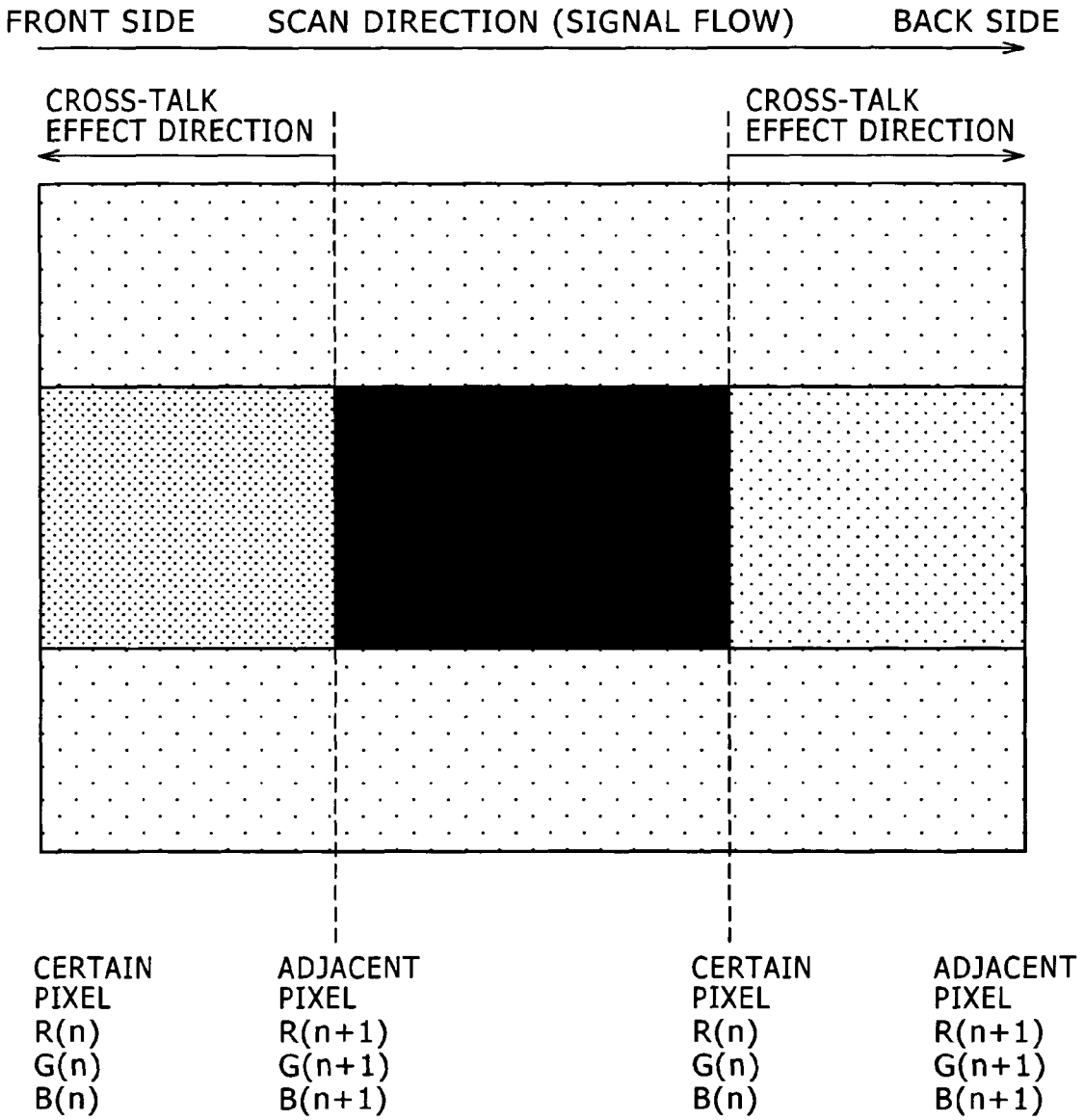
FIG. 6 is an explanatory diagram to be referred to in description of the technology in related art.
Figure 7:
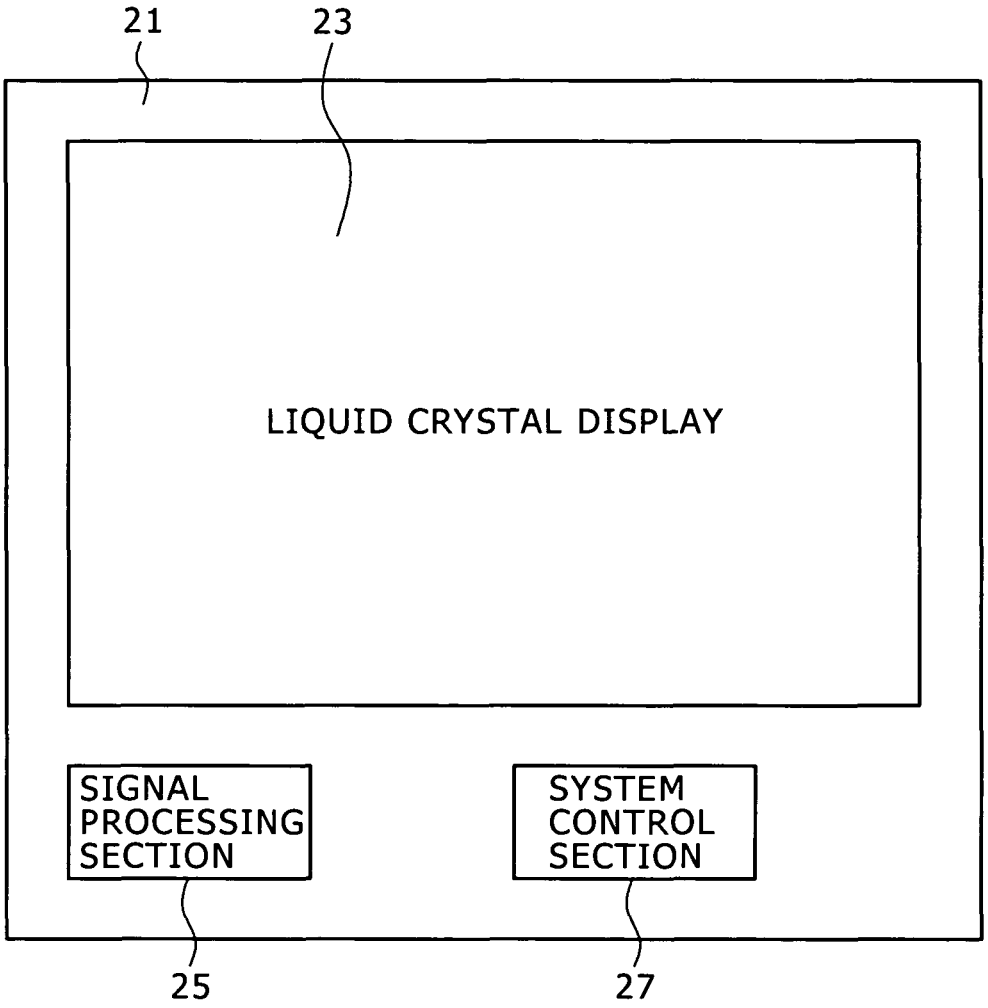
FIG. 7 is a diagram showing main configuration components of a liquid-crystal display apparatus according to an embodiment of the present invention.

FIG. 7 is a diagram showing main configuration components of a liquid-crystal display apparatus 21 according to the embodiment. The liquid-crystal display apparatus 21 employs a liquid-crystal display 23, a signal processing section 25, a system control section 27 and the driving circuits shown in the diagram of FIG. 1. The driving circuits shown in the diagram of FIG. 1 are not shown in the diagram of FIG. 7.

The liquid-crystal display 23 employs a backlight (or a light source) not shown in the figure and a liquid-crystal panel. The liquid-crystal panel has a substrate module shown in the diagram of FIG. 1, a liquid-crystal layer and a front-face module including a color filter and other components. Since the structure of the liquid-crystal display 23 is already commonly known, its details are not explained.

The signal processing section 25 is a processing device for processing an input image signal in order to generate a signal format suitable for the display on the liquid-crystal panel.

Figure 8:
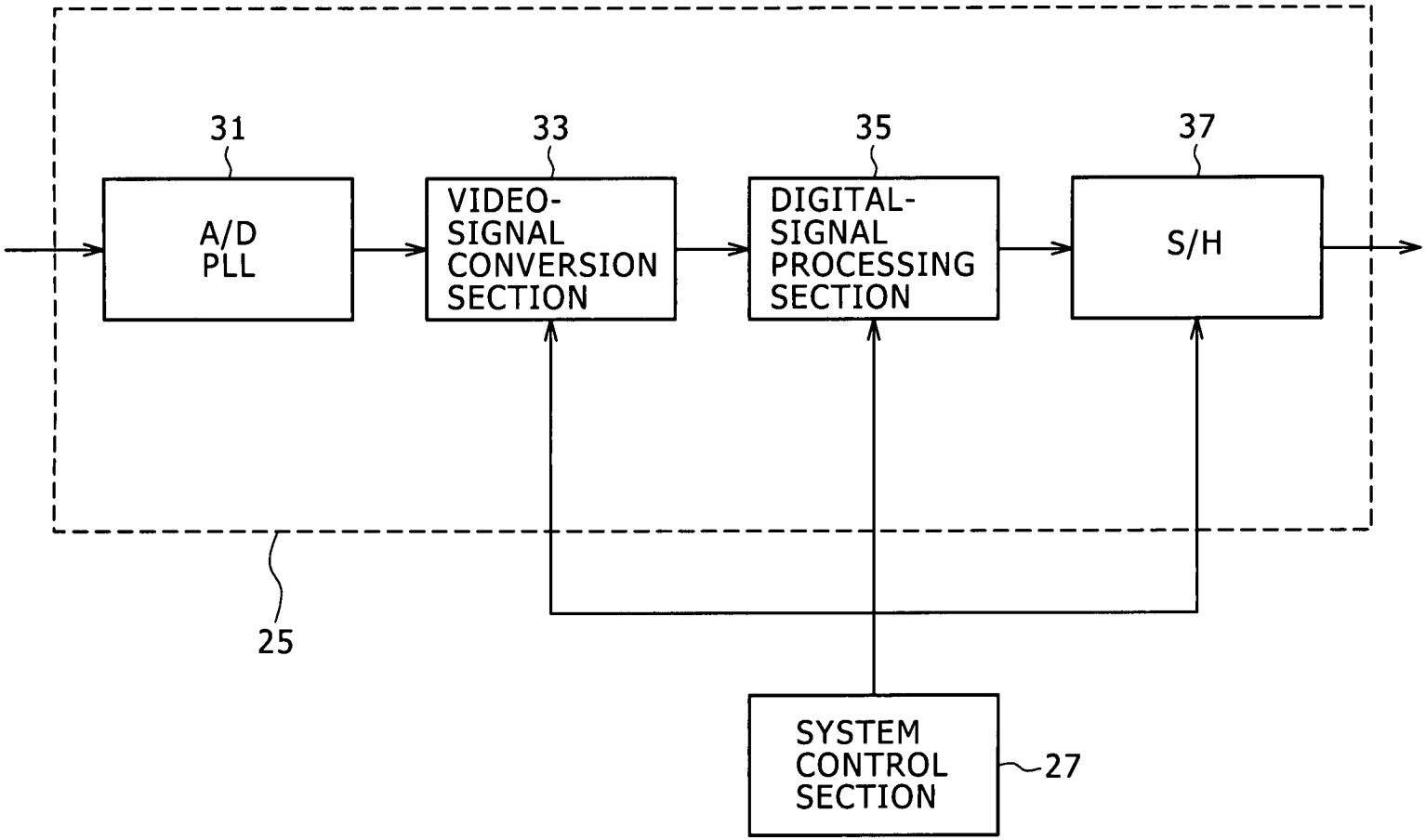
FIG. 8 is a block diagram showing a typical internal configuration of a signal processing section employed in the liquid-crystal display apparatus shown in the diagram of FIG. 7.

FIG. 8 is a block diagram showing a typical internal configuration of the signal processing section 25. The signal processing section 25' employs an A/D-PLL section 31, a video-signal conversion section 33, a digital-signal processing section 35 and a sample hold section 37.

The A/D-PLL section 31 is a processing device for carrying out a process to convert an analog input image signal into digital pixel data and a phase synchronization process.

The video-signal conversion section 33 is a processing device for carrying out a process to convert the digital pixel data output by the A/D-PLL section 31 into pixel data (or elementary-color data) adapted to the number of pixels on the liquid-crystal panel and the clock frequency.

The digital-signal processing section 35 is a processing device for carrying out a contrast adjustment process and a cross-talk compensation process. A horizontal-cross-talk compensation process to be described later is also carried out by the digital-signal processing section 35.

The sample hold section 37 is a processing device for carrying out a sample hold process on the pixel data (or elementary-color data) output by the digital-signal processing section 35 in order to generate data used for driving the liquid-crystal panel.

The system control section 27 is a control unit for controlling the whole liquid-crystal display apparatus. To be more specific, the system control section 27 is a control unit for controlling the video-signal conversion section 33, the digital-signal processing section 35, the sample hold section 37 and the like.

(B) Horizontal-Cross-Talk Compensation Process

(B-1) Typical Process 1

Figure 9:
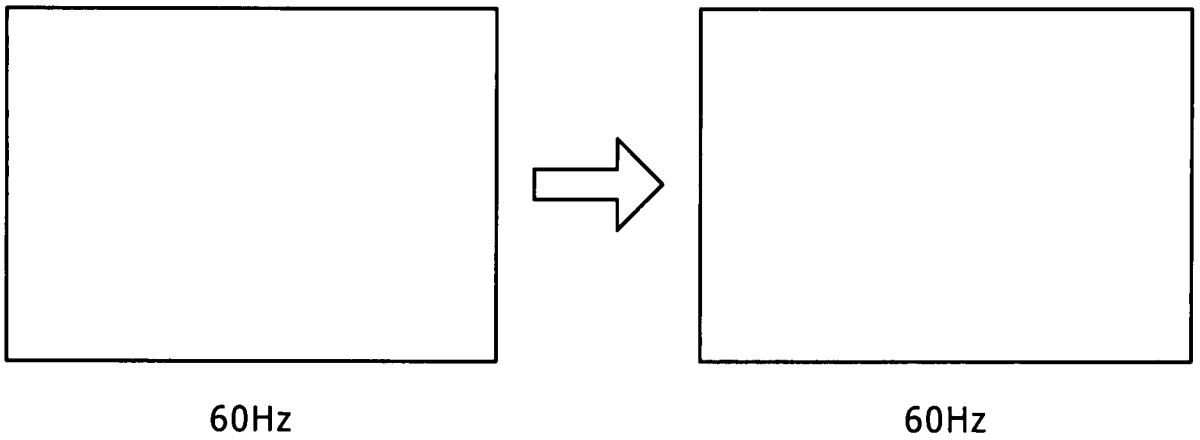
FIG. 9 is an explanatory diagram showing a relation assumed for typical process 1 as a relation between the vertical scan frequency of an input and the vertical scan frequency of an output.

In the process described below, it is assumed that the vertical scan frequency on the input side is equal to that on the output side as shown in a diagram of FIG. 9.

Figure 10:
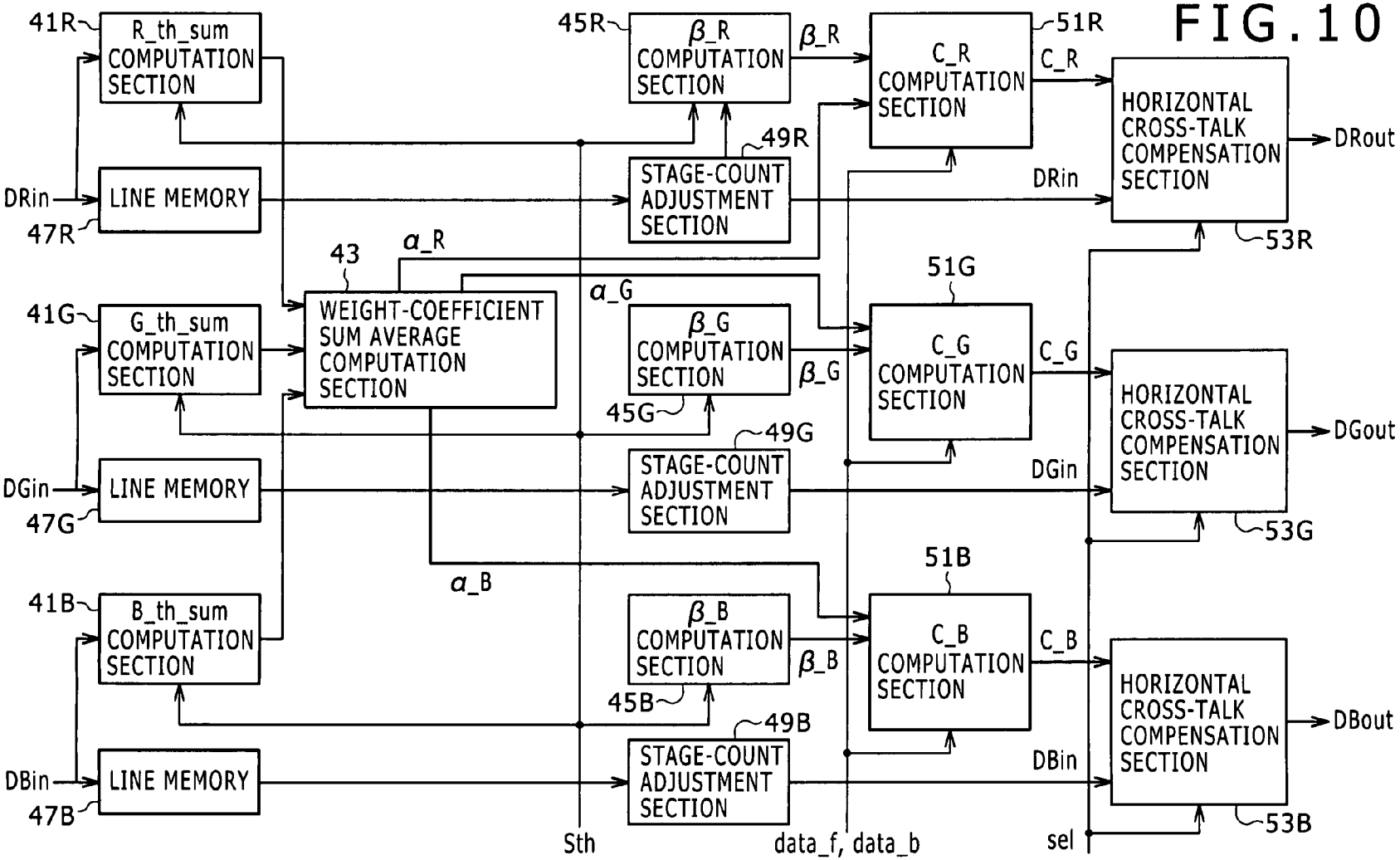
FIG. 10 is a block diagram showing a preferred typical circuit configuration of a digital-signal processing section employed in the signal processing section shown in the block diagram of FIG. 8 as a digital-signal processing section according to an embodiment of the present invention.

FIG. 10 is a block diagram showing a preferred typical circuit configuration of the digital-signal processing section 35 according to an embodiment of the present invention. It is to be noted that the entire circuit configuration shown in the block diagram of FIG. 10 can be implemented as an integrated circuit or implemented as a combination of integrated-circuit and software processing.

The digital-signal processing section 35 shown in the block diagram of FIG. 10 includes some functional blocks. A process carried out by each of the functional blocks is explained as follows.

(a) Blocks each used for computing a line-unit sum of weight coefficients for each elementary-color data (and for each line unit)

The first functional blocks are each used for computing a line-unit sum of weight coefficients for each elementary-color data and for each horizontal line unit. In the digital-signal processing section 35 shown in the block diagram of FIG. 10, a R_th_sum computation section 41R is a functional block provided for R data DRin, a G_th_sum computation section 41G is a functional block provided for G data DGin and a B_th_sum computation section 41B is a functional block provided for B data DBin.

First of all, each of the R_th_sum computation section 41R, the G_th_sum computation section 41G and the B_th_sum computation section 41B carries out a process to compare the gradation level of elementary-color data with a pair of threshold values for each pixel and convert the gradation level into a weight coefficient corresponding to the result of the comparison. FIG. 11 is a diagram showing a typical relation between the range of gradation levels and the weight coefficient. The typical relation shown in the diagram of FIG. 11 shows a relation between 5 ranges of gradation levels and 5 weight coefficients respectively. It is to be noted that the threshold values for comparison are given as boundary values in each range.

In the case of this embodiment, the range 000h to 200h very close to the black level is associated with a weight coefficient of 2, the range 200h to 400h relatively close to the black level is associated with a weight coefficient of 1, the range 400h to 600h in the middle is associated with a weight coefficient of 0, the range 600h to 800h relatively close to the white level is associated with a weight coefficient of −1 and the range 800h to FFFh very close to the white level is associated with a weight coefficient of −2.

In addition, in the case of this embodiment, the same threshold-value pairs Sth shown in the diagram of FIG. 11 as pairs of threshold values are used for the R, G and B data. However, different pairs of threshold values can also be used for the R, G and B data. It is to be noted that the threshold-value pairs Sth are received from an external source and stored in an internal memory.

Each of the R_th_sum computation section 41R, the G_th_sum computation section 41G and the B_th_sum computation section 41B cumulatively sums up weight coefficients obtained as a result of a process carried out along 1 horizontal line to convert elementary-color data and outputs the cumulative sum which is obtained immediately before the elementary-color data is switched to the next horizontal line. That is to say, the R_th_sum computation section 41R, the G_th_sum computation section 41G and the B_th_sum computation section 41B output weight-coefficient cumulative sums R_th_sum, G_th_sum and B_th_sum respectively. It is to be noted that, after the R_th_sum computation section 41R, the G_th_sum computation section 41G and the B_th_sum computation section 41B output weight-coefficient cumulative sums R_th_sum, G_th_sum and B_th_sum respectively, the R_th_sum computation section 41R, the G_th_sum computation section 41G and the B_th_sum computation section 41B reset the weight-coefficient cumulative sums R_th_sum, G_th_sum and B_th_sum respectively.

Figures 12A, 12B:
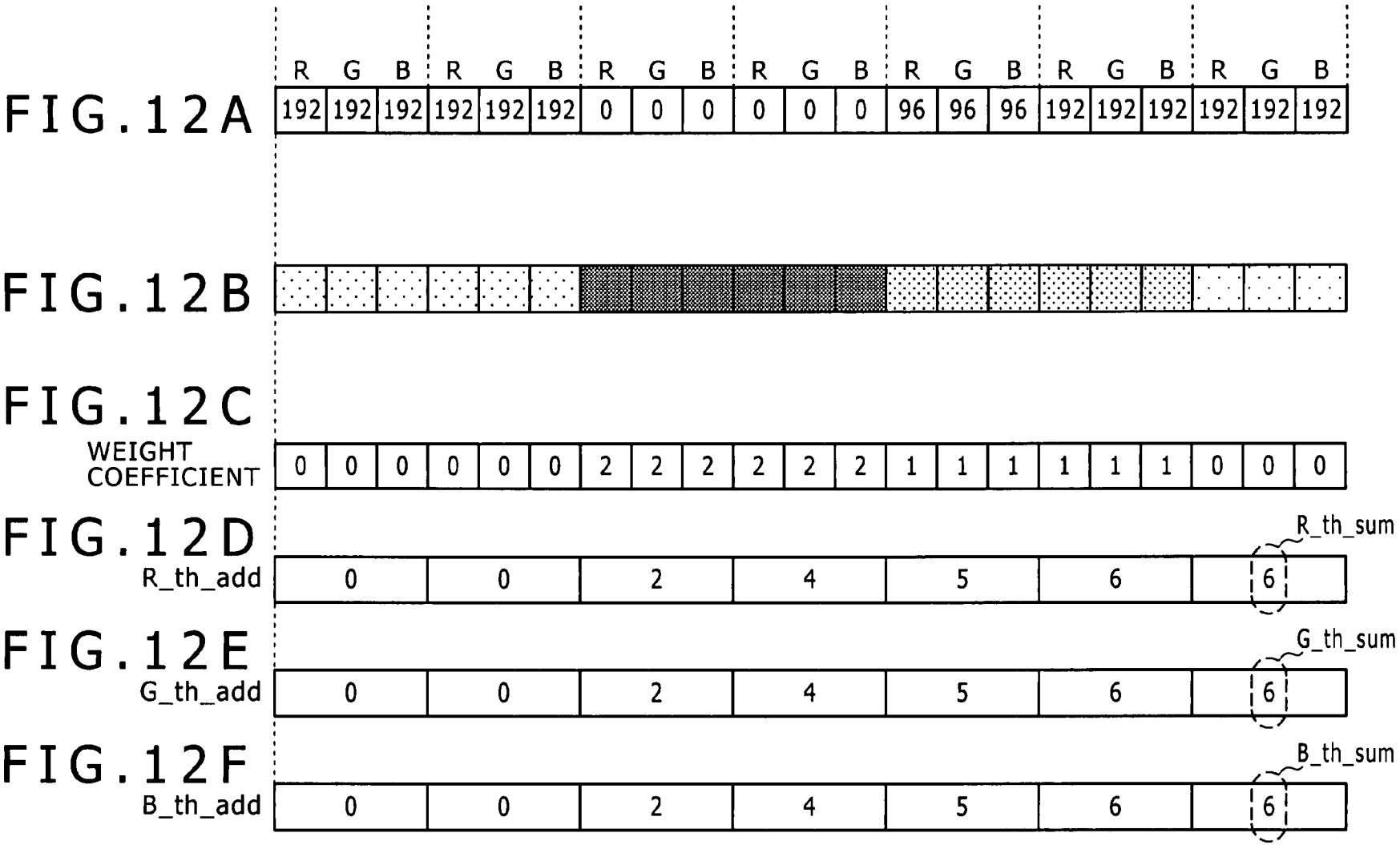
Figures 14A, 14B:
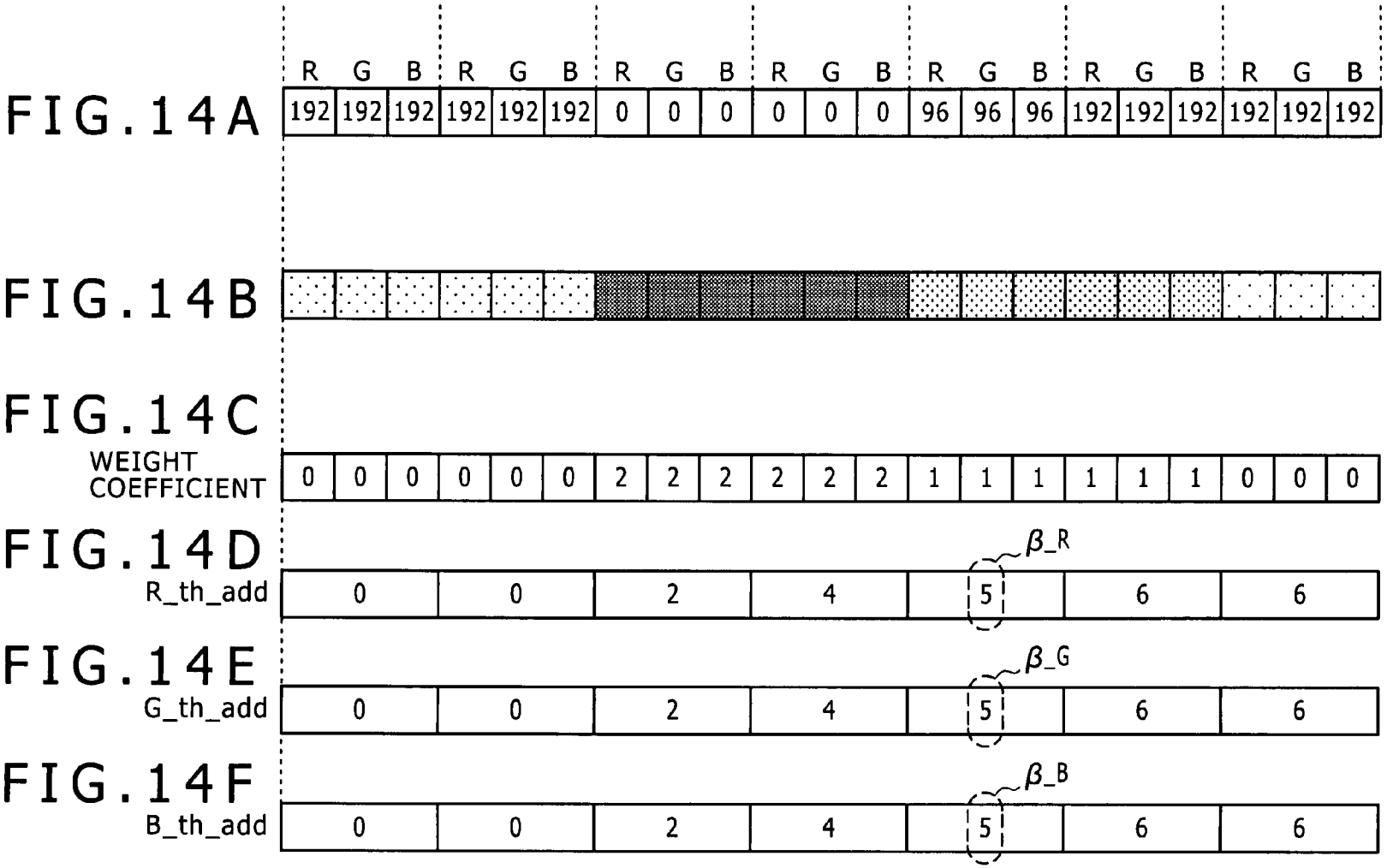

FIGS. 12A to 12F are a plurality of diagrams showing images of the line-unit weight-coefficient cumulative sums R_th_sum, G_th_sum, and B_th_sum. To be more specific, FIG. 12A is a diagram showing a typical input of elementary-color data. Notations R, G and B shown in the diagram of FIG. 12A denote elementary-color data for the R, G and B color respectively. Each number shown in the diagram of FIG. 12A is a data value in the range 0 to 255 for a data length of 8 bits.

FIG. 12B is a diagram showing an image of a typical display for the elementary-color data shown in the diagram of FIG. 12A. The concentrations of the image correspond to the numbers shown in the diagram of FIG. 12A. The smaller the number becomes, the higher the concentration becomes. It is to be noted that, due to limitations to create a drawing, each of the concentrations shown in the diagram of FIG. 12B represents a value obtained as a result of conversion of the concentration into a gray-scale value.

FIG. 12C is a diagram showing typical weight coefficients each obtained as a result of an operation to convert the value of elementary-color data shown in the diagram of FIG. 12A.

FIG. 12D is a diagram showing changes of a cumulative sum of weight coefficients for the R data. It is to be noted that a weight-coefficient sum enclosed in a dashed-line circle is the so-called line-unit weight-coefficient sum R_th_sum.

FIG. 12E is a diagram showing changes of a cumulative sum of weight coefficients for the G data. It is to be noted that a weight-coefficient sum enclosed in a dashed-line circle is the so-called line-unit weight-coefficient sum G_th_sum. Likewise, FIG. 12F is a diagram showing changes of a cumulative sum of weight coefficients for the B data. It is to be noted that a weight-coefficient sum enclosed in a dashed-line circle is the so-called line-unit weight-coefficient sum B_th_sum.

The R_th_sum computation section 41R, the G_th_sum computation section 41G and the B_th_sum computation section 41B thus compute information of line-unit weight-coefficient sums each representing elementary-color data of not only some pixels but all pixels on the entire line unit.

(b) Block for Computing an Average of Weight-Coefficient Sums

The second functional block is a functional block for computing a compensation coefficient reflecting other color information of each line for each elementary-color data. A weight-coefficient sum average computation section 43 employed in the digital-signal processing section 35 shown in the block diagram of FIG. 10 is the second functional block. It is to be noted that the block for computing an average of weight-coefficient sums is a compensation-coefficient computation section described in appended claims.

The weight-coefficient sum average computation section 43 shown in the block diagram of FIG. 10 computes a compensation coefficient for each elementary-color data. The compensation coefficient is computed by the weight-coefficient sum average computation section 43 for each elementary-color data as an average of the line-unit sums, which are each a sum of weight coefficients each reflecting other color information of the same line. Besides, the compensation coefficient is computed by the weight-coefficient sum average computation section 43 for each elementary-color data as a product obtained by computing a total sum of the line-unit sums, which are each a sum of weight coefficients each reflecting other color information of the same line, at a predetermined ratio.

It is to be noted that a method for computing compensation coefficients is provided in advance. FIG. 13 shows computation examples each used for computing compensation coefficients. In accordance with computation example 1, weight-coefficient sum averages α_R, α_G and α_B for the R, G and B data respectively are computed by using the same calculation formula based on the weight-coefficient sums R_th_sum, G_th_sum and B_th_sum. In this case, the weight-coefficient sum averages α_R, α_G and α_B have values equal to each other.

In accordance with computation example 2, on the other hand, the weight-coefficient sum averages α_R, α_G and α_B for the R, G and B data respectively are computed by using different calculation formulas based on the weight-coefficient sums R_th_sum, G_th_sum and B_th_sum. It is to be noted that the weight-coefficient sum average α_R for the R data is denoted by P_r. By the same token, the weight-coefficient sum average α_G for the G data is denoted by P_g. In the same way, the weight-coefficient sum average α_B for the B data is denoted by P_b.

As described above, blocks for computing an average of the weight-coefficient sums compute each of the weight-coefficient sum averages α_R, α_G and α_B for the R, G and B data respectively as a compensation coefficient reflecting data of all pixels on the same line.

(c) Blocks each used for computing a partial weight-coefficient sum for each elementary-color data (till the position of a pixel serving as a processing subject)

The third blocks are functional blocks each used for computing a partial weight-coefficient sum for each elementary-color data in a range ending at the position of a pixel serving as a processing subject.

A α_R computation section 45R shown in the block diagram of FIG. 10 is the third functional block provided for the R data DRin. By the same token, a β_G computation section 45G shown in the block diagram of FIG. 10 is the third functional block provided for the G data DGin. Likewise, a β_B computation section 45B shown in the block diagram of FIG. 10 is the third functional block provided for the B data DBin.

It is to be noted that, in order to adjust the execution timing of the process to compute a partial weight-coefficient sum for each elementary-color, the digital-signal processing section 35 shown in the block diagram of FIG. 10 also employs line memories 47R, 47G and 47B for the R data DRin, the G data DGin and the B data DBin respectively as well as stage-count adjustment sections 49R, 49G and 49B. Each of the line memories 47R, 47G and 47B is a storage medium for storing elementary-color data of 1 horizontal line for a time-adjustment purpose. On the other hand, the stage-count adjustment sections 49R, 49G and 49B are sections for adjusting pixel positions of elementary-color data read out from the line memories 47R, 47G and 47B respectively.

The processing operations carried out by the β_R computation section 45R, the β_G computation section 45G and the β_B computation section 45B are basically identical with those carried out by the R_th_sum computation section 41R, the G_th_sum computation section 41G and the B_th_sum computation section 41B respectively. However, the β_R computation section 45R, the β_G computation section 45G and the β_B computation section 45B output sums each computed till the position of a pixel, which serves as a processing subject, as partial sums of weight coefficients. The partial weight-coefficient sums computed by the β_R computation section 45R, the β_G computation section 45G and the β_B computation section 45B are referred to as partial weight-coefficient sums β_R, β_G and β_B respectively.

FIGS. 14A to 14F are a plurality of diagrams showing images of the computed partial weight-coefficient sums β_R, β_G and β_B. To be more specific, FIGS. 14A to 14F correspond to FIGS. 12A to 12F respectively.

The β_R computation section 45R, the β_G computation section 45G and the β_B computation section 45B compute respectively partial weight-coefficient sums β_R, β_G and β_B each reflecting information on data of some pixels on the front side of the scan direction as seen from the position of a pixel serving as the processing subject for elementary-color data.

(d) Compensation-Quantity Computation Blocks

The fourth blocks are each a functional block for computing a compensation quantity corresponding to the present point of compensation for each of colors independently of each other.

A C_R computation section 51R shown in the block diagram of FIG. 10 is the fourth functional block provided for the R data DRin. By the same token, a C_G computation section 51G shown in the block diagram of FIG. 10 is the fourth functional block provided for the G data DGin. Likewise, a C_B computation section 51B shown in the block diagram of FIG. 10 is the fourth functional block provided for the B data DBin.

FIG. 15 shows typical computing equations used for computing compensation quantities C_R, C_G and C_B. Each of computing coefficients R_data_f, G_data_f and B_data_f used in the computing equations shown in the figure is a computing coefficient used for determining a compensation quantity component for the front side of the scan direction. On the other hand, each of computing coefficients R_data_b, G_data_b and B_data_b used in the computing equations shown in the figure is a computing coefficient used for determining a compensation quantity component for the back side of the scan direction. The computing coefficients R_data_f, G_data_f and B_data_f as well as the coefficients R_data_b, G_data_b and B_data_b are supplied to the C_R computation section 51R, the C_G computation section 51G and the C_B computation section 51B respectively.

It is to be noted that a computing coefficient common to all colors can be used as a common coefficient for the front side of the scan direction. That is to say, the computing coefficients R_data_f, G_data_f and B_data_f are set at the same value. By the same token, a coefficient common to all colors can be used as a common coefficient for the back side of the scan direction. That is to say, the computing coefficients R_data_b, G_data_b and B_data_b are set at the same value. In addition, for all colors, the same computing coefficient can be used without regard to the gradation level of the elementary-color data. As an alternative, the computing coefficient used for each color can be changed in accordance with the gradation level of the elementary-color data.

In the case of this embodiment, each of the computing coefficients R_data_f, G_data_f and B_data_f is set at 2 whereas each of the computing coefficients R_data_b, G_data_b and B_data_b is set at 3. Incidentally, setting the computing coefficients at these values of 2 and 3 increases the ratio of the compensation quantity component working for the back side of the scan direction.

Figure 16:
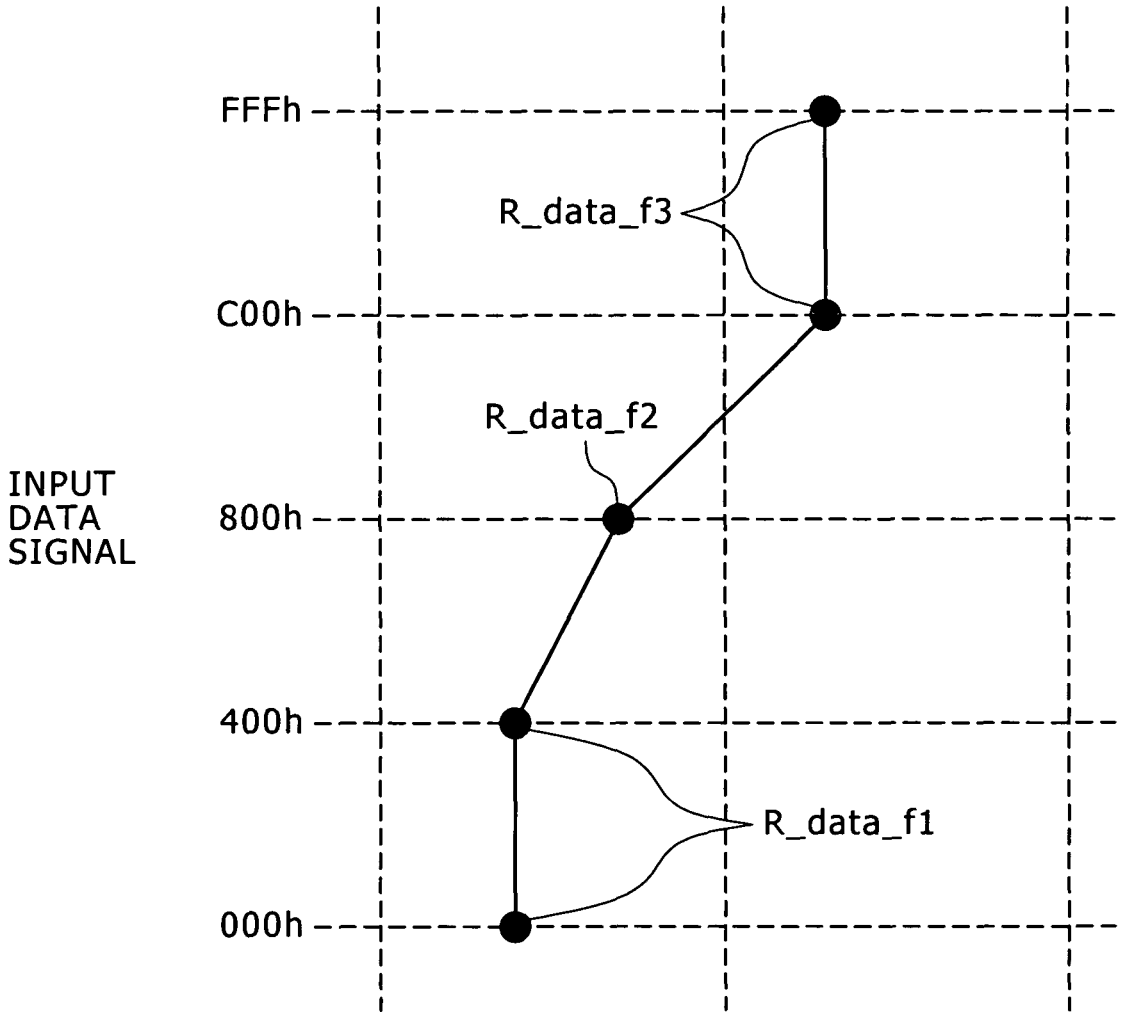
FIG. 16 is a diagram showing an example of changing a computing coefficient, which is used for a color, in accordance with the gradation level of the elementary-color data.

FIG. 16 is a diagram showing an example of changing a computing coefficient, which is used for a color, in accordance with the gradation level of the elementary-color data as described above. To be more specific, FIG. 16 shows an example of changing the computing coefficient R_data_f used for computing a compensation quantity on the front side of the scan direction for the R data in accordance with the gradation level of the input data signal.

If a computing coefficient varying in accordance with gradation level is used in this way, that is, if one computing coefficient R_data_f is used for each gradation level, the amount of information undesirably increases.

For this reason, this embodiment adopts a method which receives values of the computing coefficient R_data_f at different gradation levels from an external source. Each of black circles shown in the diagram of FIG. 16 is referred to as a compensation point. That is to say, the external source supplies a gradation level and a value of the computing coefficient R_data_f for each compensation point at which the gradation level and the value of the computing coefficient R_data_f generally change.

It is to be noted that the value of the computing coefficient R_data_f at a point between two adjacent compensation points corresponding to different gradation levels is found by interpolation based on the values of the computing coefficient R_data_f at the two adjacent compensation points.

Incidentally, a compensation quantity component for the front side of the scan direction is a product obtained as a result of multiplying a difference described above by a computing coefficient data_f for the elementary-color data. The difference multiplied by the computing coefficient data_f for elementary-color data is the difference between a compensation coefficient computed from line-unit sums of weight coefficients for the elementary-color data and a partial weight-coefficient sum for the elementary-color data. Thus, the compensation quantity component for the front side of the scan direction reflects information on gradation levels of all pixels composing one line for the elementary-color data and information on a gradation level for the front side of the scan direction for the elementary-color data.

On the other hand, a compensation quantity component for the back side of the scan direction is a product obtained as a result of multiplying the compensation coefficient computed from line-unit sums of weight coefficients for the elementary-color data by a computing coefficient data_b for the elementary-color data. Thus, a compensation quantity component for the back side of the scan direction for elementary-color data reflects information on gradation levels of all pixels composing 1 line for the elementary-color data.

Then, by finding the sum of the two compensation quantity components having different scan directions, the compensation quantities C_R, C_G and C_B for pixel positions can be computed for each elementary-color data.

Figures 17A, 17B, 17C, 17D, 17E:
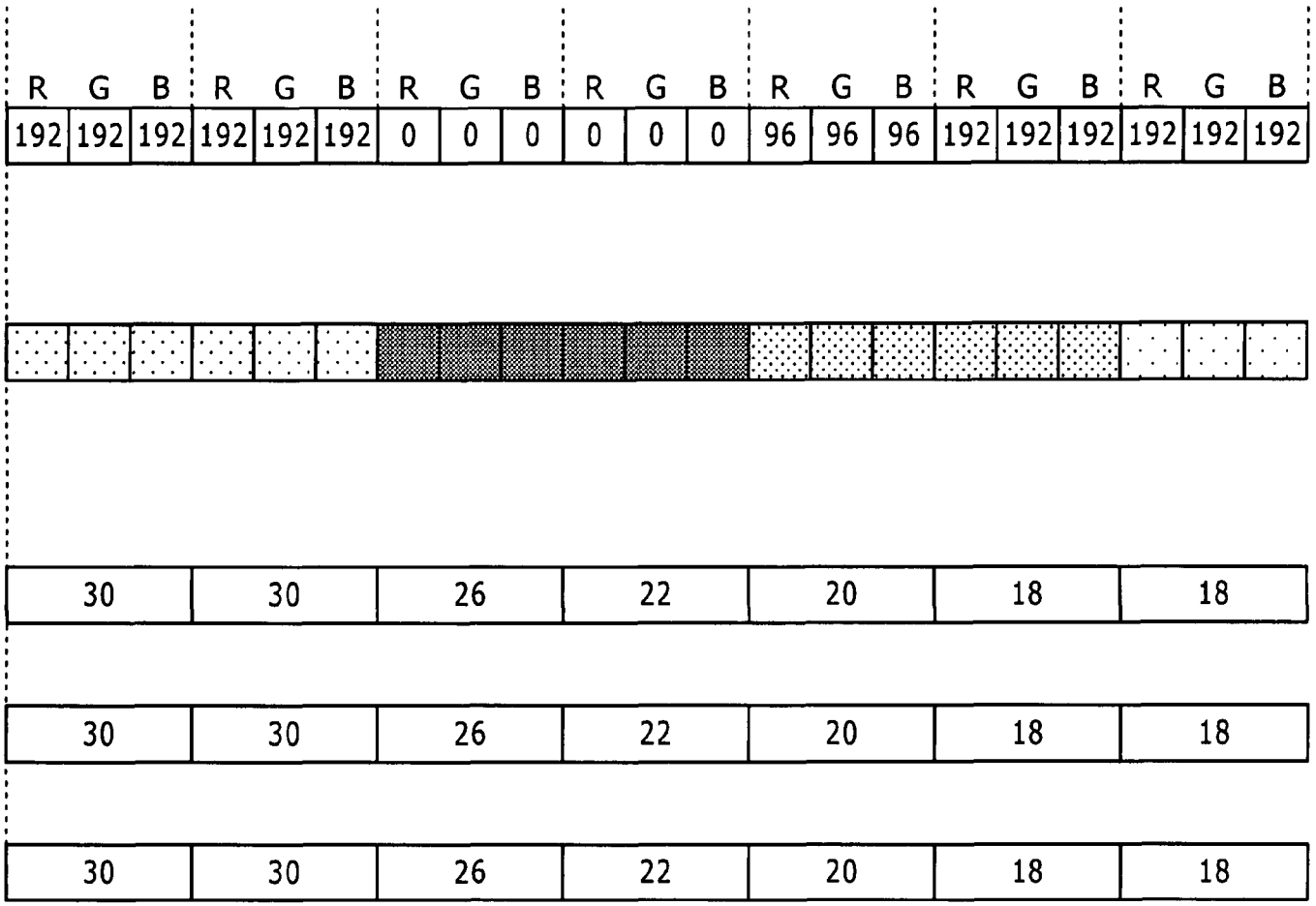
FIGS. 17A to 17E are a plurality of diagrams showing computed images of the compensation quantities C_R, C_G and C_B.

FIGS. 17A to 17E are a plurality of diagrams showing computed images of the compensation quantities C_R, C_G and C_B. To be more specific, FIG. 17A is a diagram showing an input sequence of elementary-color data. Notations R, G and B shown in the diagram of FIG. 17A denote elementary-color data for the R data, G data and B data respectively. Each number shown in the diagram of FIG. 17A is a data value in the range 0 to 255 for a data length of 8 bits.

FIG. 17B is a diagram showing an image of a typical display for the elementary-color data shown in the diagram of FIG. 17A. The concentrations of the image correspond to the numbers shown in the diagram of FIG. 17A. The smaller the number becomes, the higher the concentration becomes. It is to be noted that, due to limitations to create a drawing, each of the concentrations shown in the diagram of FIG. 17B represents a value obtained as a result of conversion of the concentration into a gray-scale value.

FIG. 17C is a diagram showing typical values of the compensation quantity C_R for the R data. By the same token, FIG. 17D is a diagram showing typical values of the compensation quantity C_G for the G data. Likewise, FIG. 17E is a diagram showing typical values of the compensation quantity C_B for the B data.

As is obvious from the diagrams of FIGS. 17C to 17E, for a pixel area with a large luminance difference, on each of the front and back sides of the scan direction, compensation quantities each reflecting the magnitude of the effect of a horizontal cross talk are determined.

(e) Horizontal-Cross-Talk Compensation Blocks

The fifth blocks are each a functional block for compensating elementary-color data at the position of a pixel serving as a processing subject on the basis of successively output compensation quantities C_R, C_G and C_B for each of elementary-color data. A horizontal-cross-talk compensation section 53R, 53G and 53B are fifth functional blocks provided for the R data DRin, G data DGin and B data DBin respectively.

The horizontal-cross-talk compensation section 53R, 53G and 53B carry out a process to add the compensation quantities C_R, C_G and C_B described above to elementary-color data received from the stage-count adjustment section 49R, 49G and 49B respectively or subtract the compensation quantities C_R, C_G and C_B respectively from the elementary-color data received from the stage-count adjustment section 49R, 49G and 49B respectively in order to execute a process to output the result of computation to the sample hold section 37.

It is to be noted that the addition or subtraction process is selected as the compensation processing in accordance with the type of the liquid-crystal panel. The selection of the addition or subtraction process as the compensation processing is executed by a sel select signal.

(f) Summary

By adoption of the processing method described above, it is possible to reflect information on gradation levels of all pixels composing 1 line for all colors in the compensation quantities used for horizontal cross talks.

It is thus possible to compute compensation quantities required for horizontal cross talks appearing on both the front and back sides of the scan direction.

In addition, since it is possible to reflect information on gradation levels of all pixels composing 1 line for all colors in the computed compensation quantities used for compensating elementary-color data for horizontal cross talks, the compensation quantities computed for horizontal cross talks can be used for avoiding a color balance shift.

It is to be noted that, in the case of the system in related art considering only the gradation level of a particular color serving as a processing subject, even if a compensation quantity is proper for the particular color, the compensation quantity is not adjusted for another color adjacent to the particular color. In particular, if only the elementary-color data of a certain color such as the green color is at the level of the black signal, with the technology in related art, an effect on other colors cannot be compensated for.

Thus, in the case of the system in related art, the color balance collapses and a horizontal cross talk cannot but be recognized as a horizontal cross talk different from surroundings.

In addition, a color shift is generated also due to variations of the color purity of a color filter. Also in this respect, by adoption of the technology in related art, it is impossible to compensate for a horizontal cross talk so as to avoid a color shift.

As described above, the processing method according to the embodiment is superior in a variety of respects than the method provided by the technology in related art.

(B-2) Typical Process 2

Figure 18:
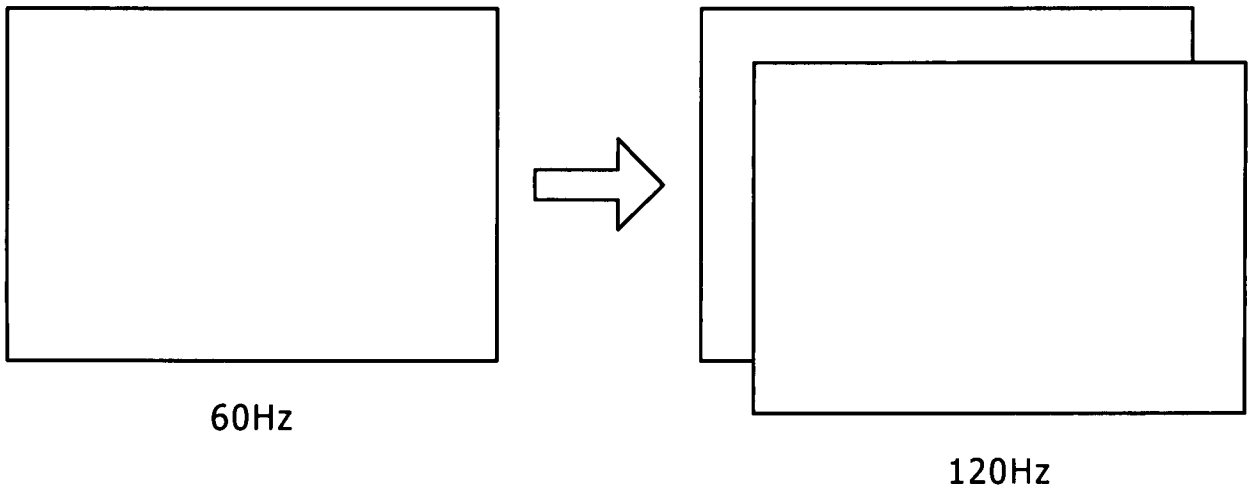
FIG. 18 is an explanatory diagram showing a relation assumed for typical process 2 as a relation between the vertical scan frequency of an input and the vertical scan frequency of an output.

In typical process 2 described below, it is assumed that the vertical scan frequency of the output is twice the vertical scan frequency of the input as shown in a diagram of FIG. 18. That is to say, it is assumed that an input image signal having a vertical scan frequency of 60 Hz is converted into an output image signal which has a vertical scan frequency of 120 Hz and represents an image to be displayed. This display method is a technology drawing much attention because the method is a technology capable of improving a moving-picture response characteristic.

Figure 19:
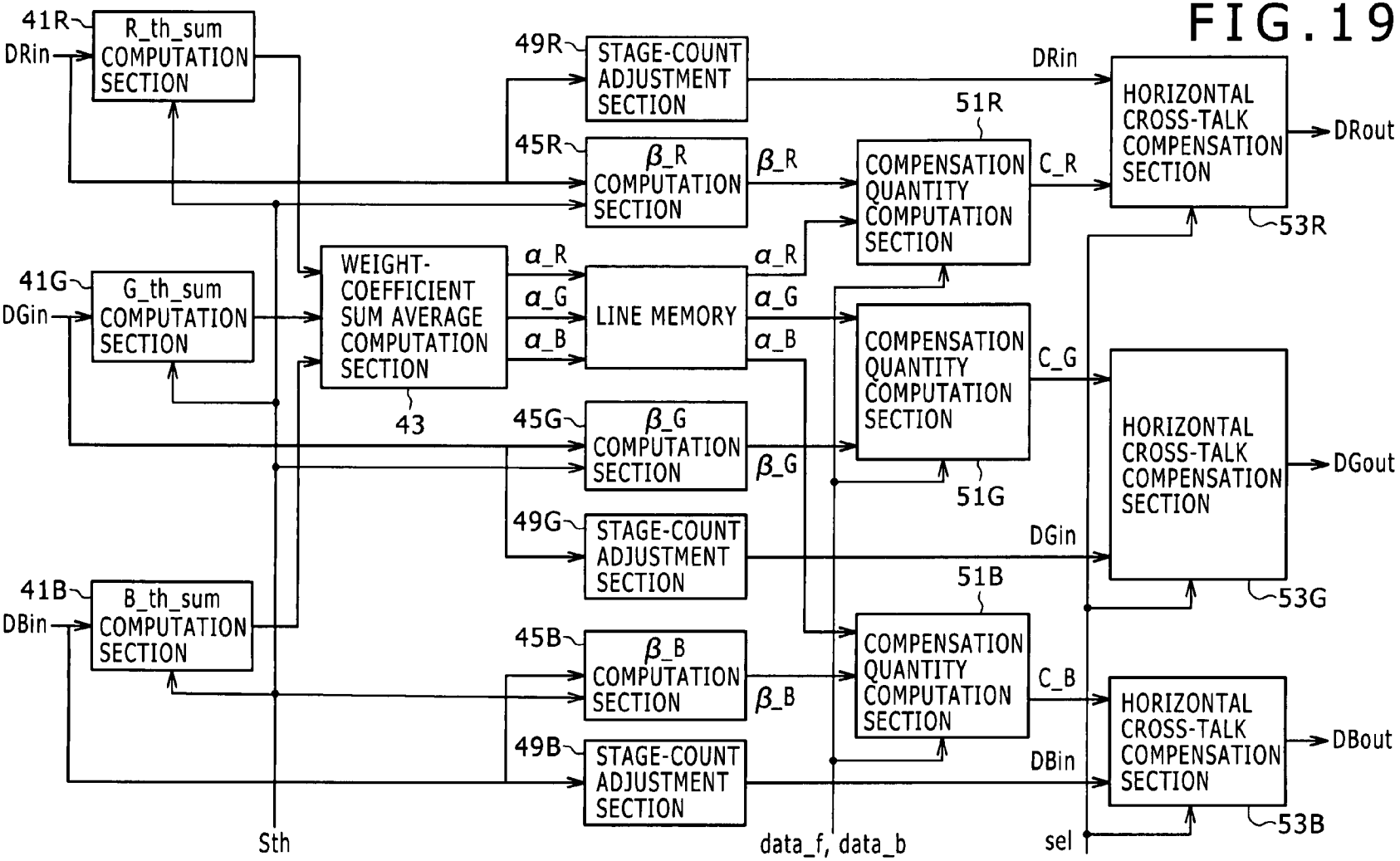
FIG. 19 is a block diagram showing a preferred typical circuit configuration of a digital-signal processing section according to another embodiment of the present invention.

FIG. 19 is a block diagram showing a typical circuit configuration that is suitably applicable to the digital-signal processing section 35 according to another embodiment. It is to be noted that the entire circuit configuration shown in the block diagram of FIG. 19 can be implemented as an integrated circuit or implemented as a combination of integrated-circuit and software processing.

The digital-signal processing section 35 shown in the block diagram of FIG. 19 includes some functional blocks. A process carried out by each of the functional blocks is explained below. It is to be noted that components shown in the block diagram of FIG. 19 as components identical with their respective counterparts shown in the block diagram of FIG. 10 are denoted by the same reference numerals as the counterparts.

It is to be noted that, in the following description, field images are explained by assuming that the images are input in units composed of two consecutive fields of the same image contents. That is to say, let the input field images composed of fields A, B, C and so on. In this case, the field images are input as fields AABBCC and so on where each of notations AA, BB, CC and so on denotes two consecutive fields of the same image contents.

The technique of inputting field images as two consecutive fields of the same image contents can also applied to a case in which the second one of the two consecutive fields is a field generated by carrying out a movement compensation process based on the image of the first one of the two consecutive fields. In this case, the field images are input as fields AA'BB'CC' and so on where each of notations A', B', C' and so on denotes a field generated by carrying out a movement compensation process based on the image of one of the immediately preceding field A, B, C and so on respectively.

(a) Blocks Each Used for Computing a Sum of Weight Coefficients for Each Elementary-Color Data (and for Each Line Unit)

Also in the case of typical process 2 described above in general for all functional blocks, the first functional blocks are each used for computing a line-unit sum of weight coefficients for each elementary-color data and for each horizontal line unit. That is to say, a R_th_sum computation section 41R is a functional block provided for R data DRin, a G_th_sum computation section 41G is a functional block provided for G data DGin and a B_th_sum computation section 41B is a functional block provided for B data DBin.

It is to be noted that typical process 2 is carried out by each of the functional blocks on the first one of the two consecutive fields. Since the substance of the typical process 2 is the same as that of typical process 1, a detailed explanation of the typical process 2 is eliminated.

(b) Block for Computing an Average of Weight-Coefficient Sums

Also in the case of typical process 2 described above, the second functional block is for computing a compensation coefficient reflecting other color information of each line for each elementary-color data.

That is to say, the weight-coefficient sum average computation section 43 shown in the block diagram of FIG. 19 computes a compensation coefficient for each elementary-color data. The compensation coefficient is computed by the weight-coefficient sum average computation section 43 for each elementary-color data as an average of the line-unit sums, which are each a sum of weight coefficients each reflecting other color information of the same line. Besides, the compensation coefficient is computed by the weight-coefficient sum average computation section 43 for each elementary-color data as a product obtained by computing a total sum of the line-unit sums, which are each a sum of weight coefficients each reflecting other color information of the same line, at a predetermined ratio.

It is to be noted that typical process 2 is carried out by this functional block on the first one of the two consecutive fields. Since the substance of the typical process 2 is the same as typical process 1, a detailed explanation of the typical process 2 is eliminated. It is also worth noting that the weight-coefficient sum averages α_R, α_B and α_G computed by the weight-coefficient sum average computation section 43 for each line unit are stored in a line memory 61 which has a storage capacity of 1 field. What is described so far is the substance of the processing carried out on the first one of the two consecutive fields.

In this way, in typical process 2, processing to compensate elementary-color data for horizontal cross talks is not carried out on the image of the first one of the two consecutive fields. Instead, the image of the first one of the two consecutive fields is output to the sample hold section 37 provided at the stage following the digital-signal processing section 35 without being subjected to these kinds of signal processing even though the flow of this image is not shown explicitly in the block diagram of FIG. 19.

(c) Blocks each used for computing a weight-coefficient sum for each elementary-color data (till the position of a pixel serving as a processing subject)

Also in the case of typical process 2 described above in general for all functional blocks, the third blocks are functional blocks each used for computing a partial weight-coefficient sum of some weight coefficients for each elementary-color data in a range ending at the position of a pixel serving as a processing subject.

A β_R computation section 45R is the third functional block provided for the R data DRin. By the same token, a β_G computation section 45G is the third functional block provided for the G data DGin. Likewise, a β_B computation section 45B is the third functional block provided for the B data DBin.

It is to be noted that typical process 2 is carried out by each of the functional blocks on the second one of the two consecutive fields. This is because, since the input image of the second field is identical to or all but identical to the image of the first field, the weight-coefficient sum averages α_R, α_B and α_G computed by the weight-coefficient sum average computation section 43 for the first field can be used. In addition, this is also because the time itself, which is assigned to the signal processing, is reduced by half in conformity with a double-speed display.

Thus, in the case of a system with a high processing performance, the operations explained in the section of typical process 1 can be selected as operations to be applied to a double-speed display. It is to be noted that, since the operations carried out by the β_R computation section 45R, the β_G computation section 45G and the β_B computation section 45B are the same as those of typical process 1, the explanation of the operations is not repeated in order to avoid duplications.

(d) Compensation-Quantity Computation Blocks

Also in the case of typical process 2 described above, the fourth blocks are each a functional block for computing a compensation quantity corresponding to the present point of compensation for each of colors independently of each other.

A C_R computation section 51R is the fourth functional block provided for the R data DRin. By the same token, a C_G computation section 51G is the fourth functional block provided for the G data DGin. Likewise, a C_B computation section 51B the fourth functional block provided for the B data DBin.

As described above, the processing carried out by each of the functional blocks is performed on the second one of the two consecutive fields.

The substance of typical process 2 described above is itself identical with that of typical process 1 except that, in the processing carried out by the C_R computation section 51R, the C_G computation section 51G and the C_R computation section 51B to compute the compensation quantities C_R, C_G and C_B respectively, the weight-coefficient sum averages α_R, α_B and α_G computed by the weight-coefficient sum average computation section 43 for the first field are used respectively. For this reason, detailed explanation of the processing carried out by each of the C_R computation section 51R, the C_G computation section 51G and the C_R computation section 51B is not given.

(e) Horizontal-Cross-Talk Compensation Blocks

Also in the case of typical process 2 described above, the fifth blocks are each a functional block for compensating elementary-color data at the position of a pixel serving as a processing subject on the basis of successively output compensation quantities C_R, C_G and C_B for each of elementary-color data. The horizontal-cross-talk compensation section 53R, 53G and 53B carry out a process to add the compensation quantities C_R, C_G and C_B respectively to elementary-color data received from the stage-count adjustment section 49R, 49G and 49B respectively or subtract the compensation quantities C_R, C_G and C_B respectively from the elementary-color data received from the stage-count adjustment section 49R, 49G and 49B respectively in order to execute a process to output the result of computation to the sample hold section 37.

As described above, the processing carried out by each of the horizontal-cross-talk compensation section 53R, 53G and 53B is processing performed on the second one of the two consecutive fields. For this reason, detailed explanation of the processing carried out by each of the fifth functional blocks is not given.

(f) Summary

The same compensation effects of typical process 2 as those of typical process 1 can be expected. In addition, typical process 2 does not require the line memory 47R for storing R data of 1 horizontal line as data of the elementary red color, the line memory 47G for storing G data of 1 horizontal line as data of the elementary green color and the line memory 47B for storing B data of 1 horizontal line as data of the elementary blue color. On the other hand, typical process 2 needs the new line memory used for storing the weight-coefficient sum averages α_R, α_B and α_G. However, the storage capacity of the line memory is dramatically smaller than the total storage capacity of the line memory 47R, the line memory 47G and the line memory 47B for typical process 1.

Thus, the size of a circuit composing the digital-signal processing section 35 can be reduced.

(C) Other Embodiments (C-1) Product Examples (a) Drive IC

The description given so far explains a liquid-crystal display apparatus constructed by assembling the apparatus from components including the liquid-crystal display 23, the signal processing section 25 and the system control section 27.

However, the components including the liquid-crystal display 23, the signal processing section 25 and the system control section 27 can also be manufactured separately from each other and distributed as components independent of each other. For example, the signal processing section 25 can be manufactured as an IC (Integrated Circuit) or ASIC (Application-Specific IC) and distributed independently of the other components.

(b) Display Modules

Figure 20:
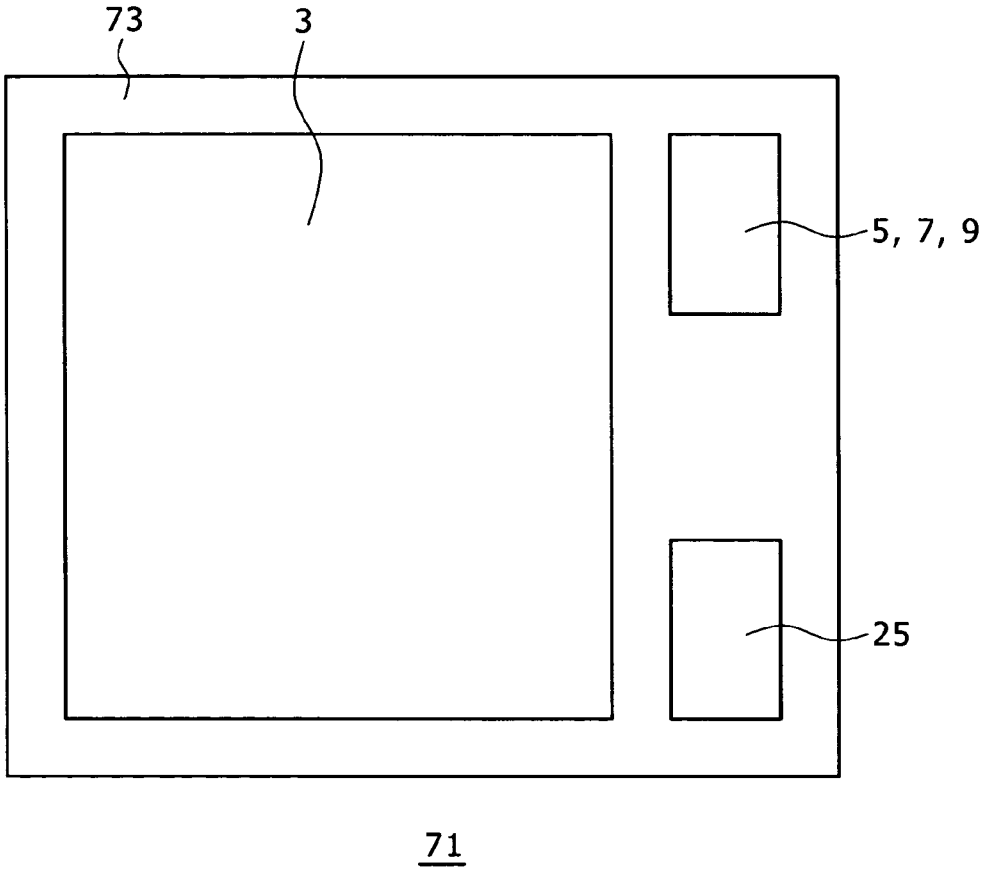
FIG. 20 is a diagram showing a typical configuration of a display module.

The liquid-crystal display 23 described previously can also be distributed in the form of a display module 71 having an external configuration like one shown in a diagram of FIG. 20.

The display module 71 has a configuration including a liquid-crystal panel 73 serving as a base having a liquid-crystal layer sandwiched by two glass substrate modules. The configuration also includes a pixel-array section 3 on the liquid-crystal panel 73. The configuration also includes components such as driving circuits, which are the H shift register 5, the H switch section 7 and the V shift register 9, as well as the signal processing section 25 in the surroundings of the pixel-array section 3.

(c) Electronic Apparatus

The function described earlier as to compensate for horizontal cross talks is distributed in not only a component employed in the liquid-crystal display apparatus 21 but also a component employed in other distributed electronic apparatus. For example, the function to compensate for horizontal cross talks can also be implemented in a component employed in a projector.

The following description explains embodiments each implementing the function to compensate for horizontal cross talks in a component employed in other electronic apparatus.

Figure 21:
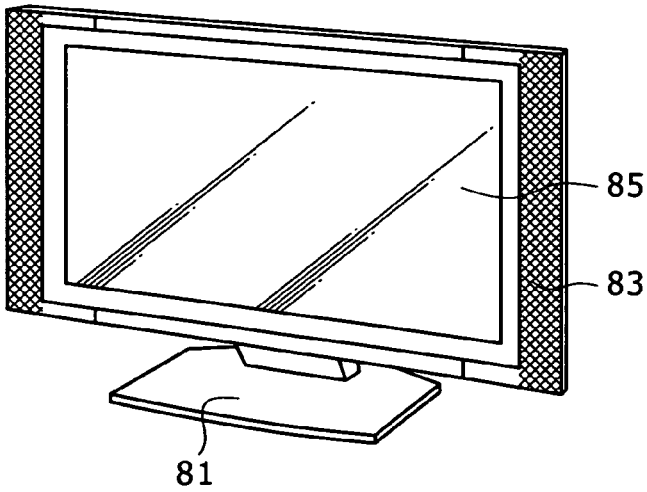
FIG. 21 is a diagram showing an external appearance of an electronic apparatus functioning as a TV receiver.

FIG. 21 is a diagram showing an external appearance of an electronic apparatus functioning as a TV receiver. The TV receiver 81 shown in the diagram of FIG. 21 has a structure including a display module 71 provided on the front face of a front panel 83. It is to be noted that, except a pixel-array section 3, components employed in the display module 71 are all concealed behind the front panel 83.

Figure 22A:
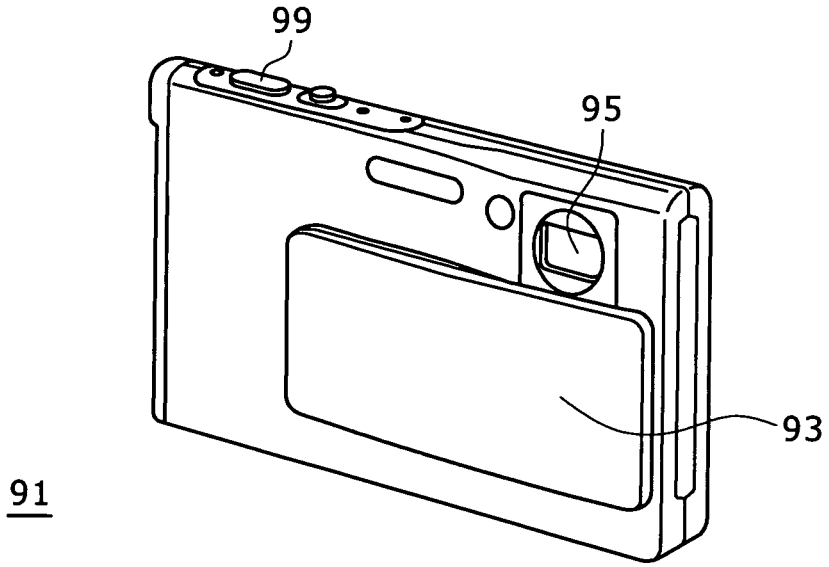
FIGS. 22A and 22B are a plurality of diagrams each showing an external appearance of an electronic apparatus functioning as a digital camera.
Figure 22B:
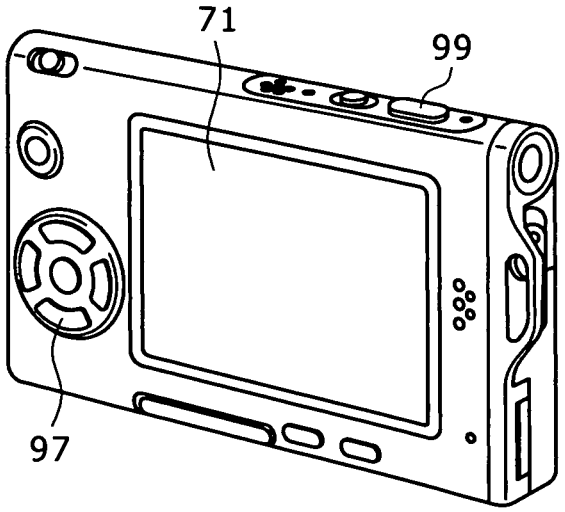

FIGS. 22A and 22B are a plurality of diagrams each showing an external appearance of an electronic apparatus functioning as a digital camera. To be more specific, FIG. 22A is a diagram showing an external appearance on the front-face side (the photographing-subject side) of the digital camera whereas FIG. 22B is a diagram showing an external appearance on the back-face side (the photographer side) of the digital camera.

The digital camera 91 has a protection cover 93, an imaging lens 95, a display module 71, a control switch 97 and a shutter button 99. It is to be noted that, except a pixel-array section 3, components employed in the display module 71 are all concealed inside the case of the digital camera 91.

Figure 23:
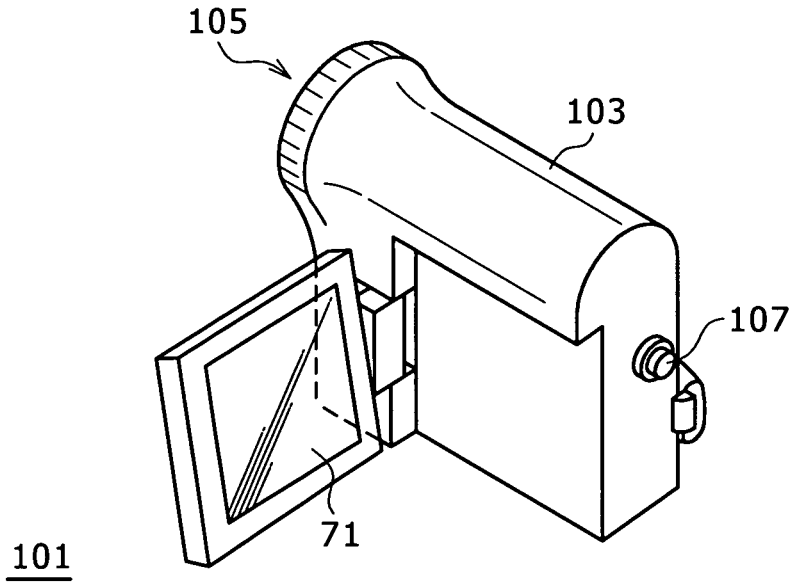
FIG. 23 is a diagram showing an external appearance of an electronic apparatus functioning as a video camera.

FIG. 23 is a diagram showing an external appearance of an electronic apparatus functioning as a video camera. The video camera 101 employs an imaging lens 105, a shooting start/stop switch 107 and a display module 71. Provided on the front side of the main body 103 of the video camera 101, the imaging lens 105 is a lens for taking a picture of a subject. It is to be noted that, except a pixel-array section 3, components employed in the display module 71 are all concealed inside the case of the video camera 101.

Figure 24A:
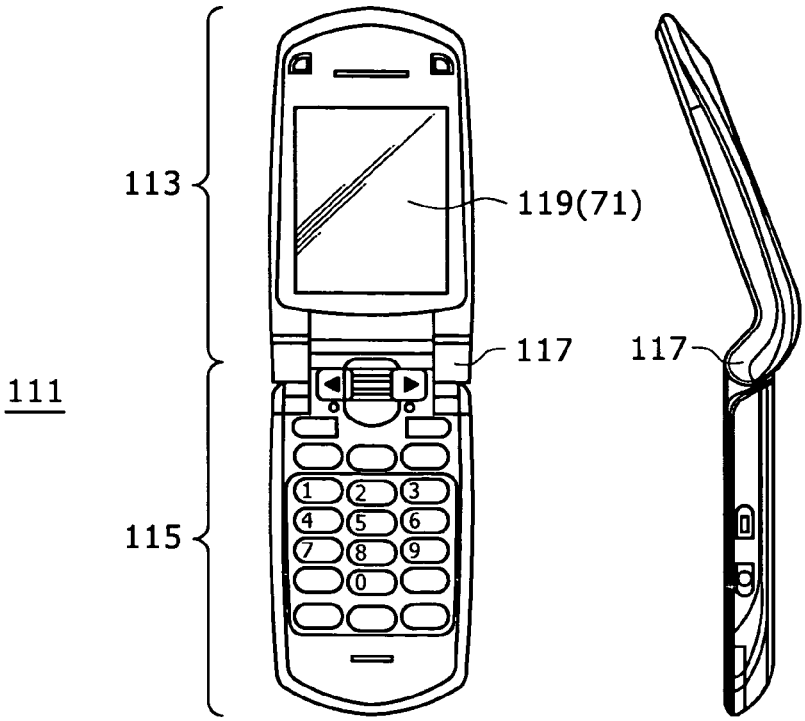
FIGS. 24A and 24B are a plurality of diagrams each showing external appearances of an electronic apparatus functioning as a cellular phone.
Figure 24B:
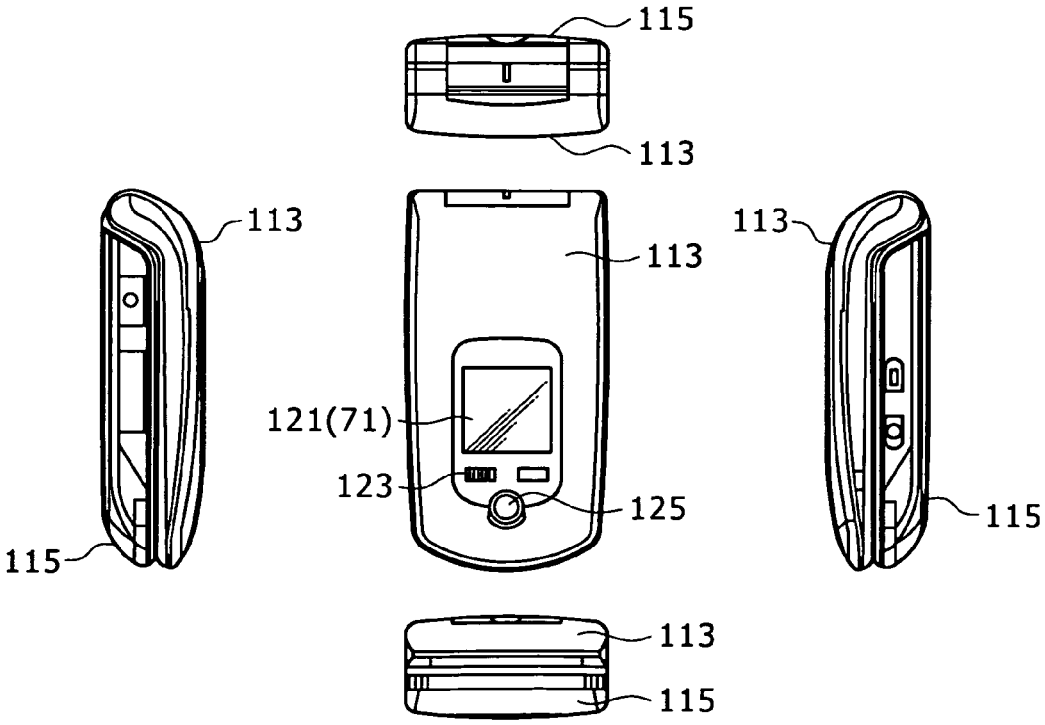

FIGS. 24A and 24B are a plurality of diagrams each showing external appearances of an electronic apparatus functioning as a cellular phone of a fold-back type. To be more specific, FIG. 24A is a diagram showing external appearances of the cellular phone 111 with the cases of the cellular phone 111 put in an opened state whereas FIG. 24B is a diagram showing external appearances of the cellular phone 111 with the cases of the cellular phone 111 put in folded-back state.

The cellular phone 111 employs an upper case 113, a lower case 115, a joining section 117, which is a hinge in the case of this typical cellular phone 111, a display module 119 functioning as the display module 71 described so far, an auxiliary display module 121 functioning as the display module 71 described so far, a picture light 123 and an imaging lens 125. It is to be noted that, except a pixel-array section 3, components employed in the display module 119 and an auxiliary display module 121 are all concealed inside the upper and lower cases 113 and 115 of the cellular phone 111.

Figure 25:
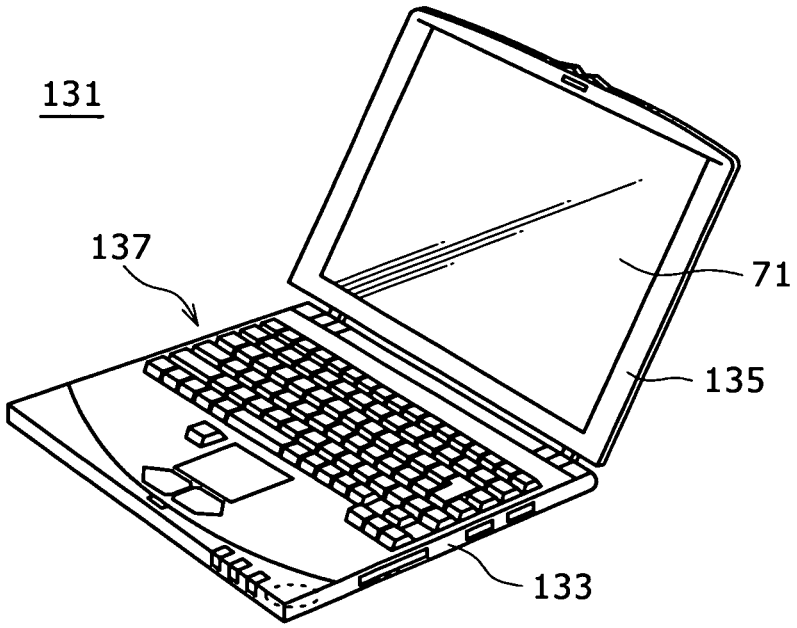
FIG. 25 is a diagram showing an external appearance of an electronic apparatus functioning as a computer.

FIG. 25 is a diagram showing an external appearance of an electronic apparatus functioning as a computer 131. The computer 131 employs a lower case 133, an upper case 135, a keyboard 137 and a display module 71. It is to be noted that, except a pixel-array section 3, components employed in the display module 71 are all concealed inside the upper and lower cases 133 and 135 of the computer 131.

The display module 71 can also be employed in electronic apparatus other than those described above.

The other electronic apparatus include an audio reproduction apparatus, a game machine, an electronic book and an electronic dictionary.

(C-3) Other Implementations

Other implementations can be conceivably constructed by changing the embodiments described above in a variety of ways with the changes not deviating from a range of purposes of the present invention. For example, the relation between the range of gradation levels and the weight coefficient into which a gradation level in the range is converted is by no means limited to the relation shown in the diagram of FIG. 11. In addition, it is also possible to conceive a variety of modified versions and a variety of typical applications as versions/applications each created or obtained as a result of combination on the basis of what is described in this patent specification.

In addition, it should be understood by those skilled in the art that a variety of modifications, combinations, sub-combinations and alterations may occur, depending on design requirements and other factors as far as they are within the scope of the appended claims or the equivalents thereof.

What is claimed is:

1. A digital-signal processing apparatus for processing elementary-color data to be output to a liquid-crystal display apparatus having a color panel structure, said digital-signal processing apparatus comprising:

a line-unit weight-coefficient sum computation section configured to compute a line-unit sum of weight coefficients, said weight coefficients including at least a black-level coefficient, a white-level coefficient, and an intermediate level coefficient, for each line unit of said weight coefficients and for each of the elementary-color data;

a compensation-coefficient computation section configured to compute a compensation coefficient reflecting other color information of each of said line units for each of the elementary-color data;

a partial-weight-coefficient-sum computation section configured to successively compute a partial weight-coefficient sum of some of the weight coefficients in a range starting from a head of each of said line units and ending at the position of a pixel serving as a processing subject for each of the elementary-color data;

a first-compensation-quantity-component computation section configured to compute a first component of a compensation quantity for each of the elementary-color data as a component effective for a front end of a scan direction for the position of said pixel serving as a processing subject on the basis of a difference between said compensation coefficient and said partial-weight-coefficient sum;

a second-compensation-quantity-component computation section configured to compute a second component of said compensation quantity for each of the elementary-color data as a component effective for a back end of said scan direction for the position of said pixel serving as a processing subject on the basis of said compensation coefficient;

a compensation-quantity computation section configured to successively compute said compensation quantity to be applied to each of the elementary-color data at the position of said pixel serving as a processing subject on the basis of said computed first and second components;

a line memory used for applying a one-line period extension process to each of the elementary-color data until a compensation quantity for each of the elementary-color data is calculated; and a horizontal-cross-talk compensation section configured to successively compensate each of the elementary-color data, which has been subjected to said 1-line period extension process in said line memory, by making use of said compensation quantity computed for each of the elementary-color data.

2. The digital-signal processing apparatus according to claim 1, wherein said compensation coefficient is computed by said compensation-coefficient computation section for each of the elementary-color data as an average of said line-unit sums, which are each a sum of the weight coefficients each reflecting other color information of the same line.

3. The digital-signal processing apparatus according to claim 1, wherein said compensation coefficient is computed by said compensation-coefficient computation section for each of the elementary-color data as a product obtained by computing a total sum of said line-unit sums, which are each a sum of the weight coefficients each reflecting other color information of the same line, at a predetermined ratio.

4. The digital-signal processing apparatus according to claim 1, wherein said compensation coefficient computed by said compensation-coefficient computation section for each of the elementary-color data is a product obtained by computing a total sum of said line-unit sums at the same ratio.

5. The digital-signal processing apparatus according to claim 1, wherein said first-compensation-quantity-component computation section computes said first component of said compensation quantity for each of the elementary-color data by multiplying said compensation quantity for each of the elementary-color data by a front-side factor changed in accordance with each of the elementary-color data, and said second-compensation-quantity-component computation section computes said second component of said compensation quantity for each of the elementary-color data by multiplying said compensation coefficient by a back-side factor changed in accordance with each of the elementary-color data.

6. The digital-signal processing apparatus according to claim 1, wherein said first-compensation-quantity-component computation section computes said first component of said compensation quantity for each of the elementary-color data by multiplying said compensation quantity for each of the elementary-color data by a front-side factor changed in accordance with each gradation level, and said second-compensation-quantity-component computation section computes said second component of said compensation quantity for each of the elementary-color data by multiplying said compensation coefficient by a back-side factor changed in accordance with said gradation level of each of the elementary-color data.

7. A digital-signal processing apparatus for processing elementary-color data to be output to a liquid-crystal display apparatus having a color panel structure, said digital-signal processing apparatus comprising:

a line-unit weight-coefficient sum computation section configured to operate for a first field during a double-speed display operation and to compute a sum of weight coefficients, said weight coefficients including at least a black-level coefficient, a white-level coefficient, and an intermediate level coefficient, for each line unit of said weight coefficients and for each of the elementary-color data;

a compensation-coefficient computation section configured to operate for the first field during the double-speed display operation and to compute a compensation coefficient reflecting other color information of each of said line units for each of the elementary-color data;

a line memory for applying a one-line period extension process to said compensation coefficient computed for the first field during the double-speed display operation;

a partial-weight-coefficient-sum computation section configured to operate for the second field during a double-speed display operation and to successively compute a partial weight-coefficient sum of some compensation coefficients in a range starting from a head of each of said line units and ending at the position of a pixel serving as a processing subject for each of the elementary-color data;

a first-compensation-quantity-component computation section configured to operate for the second field during the double-speed display operation and to compute a first component of a compensation quantity for each of the elementary-color data as a component effective for a front end of a scan direction for said position of a pixel serving as a processing subject on the basis of a difference between said compensation coefficient and said partial-weight-coefficient sum of some of the weight coefficients;

a second-compensation-quantity-component computation section configured to operate for the second field during the double-speed display operation and to compute a second component of said compensation quantity for each of the elementary-color data as a component effective for a back end of a scan direction for the position of a pixel serving as a processing subject on the basis of said compensation coefficient;

a compensation-quantity computation section configured to operate for the second field during the double-speed display operation and to successively compute said compensation quantity to be applied to each of the elementary-color data at the position of a pixel serving as a processing subject on the basis of said computed first and second components; and a horizontal-cross-talk compensation section configured to successively compensate each of the elementary-color data, which has been supplied to the second field during the double-speed display operation, by making use of said compensation quantity associated with each of the elementary-color data.

8. A liquid-crystal display apparatus having a color panel structure, said liquid-crystal display apparatus comprising:

a line-unit weight-coefficient sum computation section configured to compute a line-unit sum of weight coefficients, said weight coefficients including at least a black-level coefficient, a white-level coefficient, and an intermediate level coefficient, for each line unit of said weight coefficients and for each of the elementary-color data;

a compensation-coefficient computation section configured to compute a compensation coefficient reflecting other color information of each of said line units for each of the elementary-color data;

a partial-weight-coefficient-sum computation section configured to successively compute a partial weight-coefficient sum of some of the weight coefficients in a range starting from a head of each of said line units and ending at the position of a pixel serving as a processing subject for each of the elementary-color data;

a first-compensation-quantity-component computation section configured to compute a first component of a compensation quantity for each of the elementary-color data as a component effective for a front end of a scan direction for the position of said pixel serving as a processing subject on the basis of a difference between said compensation coefficient and said partial-weight-coefficient sum;

a second-compensation-quantity-component computation section configured to compute a second component of said compensation quantity for each of the elementary-color data as a component effective for a back end of said scan direction for the position of said pixel serving as a processing subject on the basis of said compensation coefficient;

a compensation-quantity computation section configured to successively compute said compensation quantity to be applied to each of the elementary-color data at the position of said pixel serving as a processing subject on the basis of said computed first and second components;

a line memory used for applying a one-line period extension process to each of the elementary-color data until a compensation quantity for each of the elementary-color data is calculated; and a horizontal-cross-talk compensation section configured to successively compensate each of the elementary-color data, which has been subjected to said 1-line period extension process in said line memory, by making use of said compensation quantity computed for each of the elementary-color data; and a driving section configured to drive a liquid-crystal panel of said liquid-crystal display apparatus by making use of said elementary-color data compensated by said horizontal-cross-talk compensation section.

9. A liquid-crystal display apparatus having a color panel structure, said liquid-crystal display apparatus comprising:

a line-unit weight-coefficient sum computation section to be operated for a first field during a double-speed display operation as a line-unit weight-coefficient sum computation section configured to compute a line-unit sum of weight coefficients, said weight coefficients including at least a black-level coefficient, a white-level coefficient, and an intermediate level coefficient, for each line unit of said weight coefficients and for each of the elementary-color data;

a compensation-coefficient computation section configured to operate for the first field during the double-speed display operation and to compute a compensation coefficient reflecting other color information of each of said line units for each of the elementary-color data;

a line memory used for applying a one-line period extension process to said compensation coefficient computed for the first field during the double-speed display operation;

a partial-weight-coefficient-sum computation section configured to operate for a second field during the double-speed display operation and to successively compute a partial weight-coefficient sum of some compensation coefficients in a range starting from a head of each of said line units and ending at the position of a pixel serving as a processing subject for each of the elementary-color data;

a first-compensation-quantity-component computation section to be operated for a second field during a double-speed display operation as a first-compensation-quantity-component computation section configured to compute a first component of a compensation quantity for each elementary-color data as a component effective for the front end of a scan direction for the position of a pixel serving as a processing subject on the basis of a difference between said compensation coefficient and said partial weight-coefficient sum;

a second-compensation-quantity-component computation section configured to operate for the second field during the double-speed display operation and to compute a second component of said compensation quantity for each of the elementary-color data as a component effective for a back end of said scan direction for the position of said pixel serving as a processing subject on the basis of said compensation coefficient;

a compensation-quantity computation section configured to operate for a second field during a double-speed display operation and to successively compute said compensation quantity to be applied to each of the elementary-color data at the position of a pixel serving as a processing subject on the basis of said computed first and second components;

a horizontal-cross-talk compensation section configured to successively compensate each of the elementary-color data, which has been supplied to the second field during the double-speed display operation, by making use of said compensation quantity associated with each of the elementary-color data; and a driving section configured to drive a liquid-crystal panel of said liquid-crystal display apparatus by making use of said elementary-color data compensated by said horizontal-cross-talk compensation section.

10. A digital-signal processing method for processing elementary-color data to be output to a liquid-crystal display apparatus having a color panel structure, said digital-signal processing method comprising:

computing a line-unit sum of weight coefficients, said weight coefficients including at least a black-level coefficient, a white-level coefficient, and an intermediate level coefficient, for each line unit of said weight coefficients and for each of the elementary-color data;

computing a compensation coefficient reflecting other color information of each of said line units for each of the elementary-color data;

successively computing a partial weight-coefficient sum of some of the weight coefficients in a range starting from a head of each of said line units and ending at the position of a pixel serving as a processing subject for each of the elementary-color data;

computing a first component of a compensation quantity for each of the elementary-color data as a component effective for a front end of a scan direction for the position of said pixel serving as a processing subject on the basis of a difference between said compensation coefficient and said partial-weight-coefficient sum;

computing a second component of said compensation quantity for each of the elementary-color data as a component effective for a back end of said scan direction for the position of said pixel serving as a processing subject on the basis of said compensation coefficient;

successively computing said compensation quantity to be applied to each of the elementary-color data at the position of said pixel serving as a processing subject on the basis of said computed first and second components;

performing a one-line period extension on each of the elementary-color data until the compensation quantity for each of the elementary-color data is calculated; and successively compensating each of the elementary-color data, which has been subjected to said one-line period extension, by making use of said compensation quantity computed for each of the elementary-color data.

11. A digital-signal processing method for processing elementary-color data to be output to a liquid-crystal display apparatus having a color panel structure, said digital-signal processing method comprising:

summing line-unit weight-coefficients on a first field during a double-speed display operation and computing a line-unit sum of weight coefficients, said weight coefficients including at least a black-level coefficient, a white-level coefficient, and an intermediate level coefficient, for each line unit of said weight coefficients and for each of the elementary-color data;

computing a compensation coefficient reflecting other color information of each of said line units for each of the elementary-color data on the first field during the double-speed display operation;

performing a line-period extension on said compensation coefficient computed for the first field during the double-speed display operation;

computing a partial weight-coefficient sum of some compensation coefficients in a range starting from the head of each of said line units and ending at the position of a pixel serving as a processing subject for each of the elementary-color data on a second field during the double-speed display operation;

computing, on the second field during the double-speed display operation, a first component of a compensation quantity for each of the elementary-color data as a component effective for a front end of a scan direction for the position of a pixel serving as a processing subject on the basis of a difference between said compensation coefficient and said partial weight-coefficient sum;

computing, on the second field during the double-speed display operation, a second component of said compensation quantity for each of the elementary-color data as a component effective for a back end of said scan direction for the position of said pixel serving as a processing subject on the basis of said compensation coefficient;

successively computing, on the second field during the double-speed display operation, said compensation quantity to be applied to each of the elementary-color data at the position of a pixel serving as a processing subject on the basis of said computed first and second components; and successively compensating each of the elementary-color data, which has been supplied to the second field during the double-speed display operation, by making use of said compensation quantity associated with each of the elementary-color data.

12. A non-transitory computer readable medium in which a program is recorded, the program designed to process elementary-color data to be output to a liquid-crystal display apparatus having a color panel structure, said computer program executable by a processor to perform operations comprising:

computing a line-unit sum of weight coefficients, said weight coefficients including at least a black-level coefficient, a white-level coefficient, and an intermediate level coefficient, for each line unit of said weight coefficients and for each of the elementary-color data;

computing a compensation coefficient reflecting other color information of each of said line units for each of the elementary-color data;

successively computing a partial weight-coefficient sum of some of the weight coefficients in a range starting from a head of each of said line units and ending at the position of a pixel serving as a processing subject for each of the elementary-color data;

computing a first component of a compensation quantity for each of the elementary-color data as a component effective for a front end of a scan direction for the position of said pixel serving as a processing subject on the basis of a difference between said compensation coefficient and said partial-weight-coefficient sum;

computing a second component of said compensation quantity for each of the elementary-color data as a component effective for a back end of said scan direction for the position of said pixel serving as a processing subject on the basis of said compensation coefficient;

successively computing said compensation quantity to be applied to each of the elementary-color data at the position of said pixel serving as a processing subject on the basis of said computed first and second components;

performing a one-line period extension on each of the elementary-color data until the compensation quantity for each of the elementary-color data is calculated; and successively compensating each of the elementary-color data, which has been subjected to said one-line period extension, by making use of said compensation quantity computed for each of the elementary-color data.

13. A non-transitory computer readable medium in which a program is recorded, the program designed to process elementary-color data to be output to a liquid-crystal display apparatus having a color panel structure, said computer program executable by a processor to perform operations comprising:

summing line-unit weight-coefficients on a first field during a double-speed display operation and computing a line-unit sum of weight coefficients, said weight coefficients including at least a black-level coefficient, a white-level coefficient, and an intermediate level coefficient, for each line unit of said weight coefficients and for each of the elementary-color data;

computing a compensation coefficient reflecting other color information of each of said line units for each of the elementary-color data on the first field during the double-speed display operation;

performing a line-period extension on said compensation coefficient computed for the first field during the double-speed display operation;

computing a partial weight-coefficient sum of some compensation coefficients in a range starting from the head of each of said line units and ending at the position of a pixel serving as a processing subject for each of the elementary-color data on a second field during the double-speed display operation;

computing, on the second field during the double-speed display operation, a first component of a compensation quantity for each of the elementary-color data as a component effective for a front end of a scan direction for the position of a pixel serving as a processing subject on the basis of a difference between said compensation coefficient and said partial weight-coefficient sum;

computing, on the second field during the double-speed display operation, a second component of said compensation quantity for each of the elementary-color data as a component effective for a back end of said scan direction for the position of said pixel serving as a processing subject on the basis of said compensation coefficient;

successively computing, on the second field during the double-speed display operation, said compensation quantity to be applied to each of the elementary-color data at the position of a pixel serving as a processing subject on the basis of said computed first and second components; and successively compensating each of the elementary-color data, which has been supplied to the second field during the double-speed display operation, by making use of said compensation quantity associated with each of the elementary-color data.

* * * * *